US011199797B2

(12) United States Patent
Usami et al.

(10) Patent No.: US 11,199,797 B2
(45) Date of Patent: Dec. 14, 2021

(54) IMAGE FORMING APPARATUS

(71) Applicant: Canon Kabushiki Kaisha, Tokyo (JP)

(72) Inventors: Daisuke Usami, Kanagawa (JP); Naoto Tsuchihashi, Kanagawa (JP); Tadashi Okanishi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/017,921

(22) Filed: Sep. 11, 2020

(65) Prior Publication Data

US 2021/0088953 A1 Mar. 25, 2021

(30) Foreign Application Priority Data

Sep. 20, 2019 (JP) ..... JP2019-172336

(51) Int. Cl.
*G03G 15/20* (2006.01)

(52) U.S. Cl.
CPC ..... *G03G 15/2053* (2013.01)

(58) Field of Classification Search
CPC ..... G03G 15/205; G03G 15/2017; G03G 15/2053; G03G 15/5004
See application file for complete search history.

(56) References Cited

U.S. PATENT DOCUMENTS

| | | | | |
|---|---|---|---|---|
| 7,120,371 | B2 | 10/2006 | Fujimori | |
| 8,774,663 | B2 | 7/2014 | Hirano | |
| 10,241,460 | B2 | 3/2019 | Nishihara et al. | |
| 2008/0304847 | A1* | 12/2008 | Hirano | G03G 15/2032 399/67 |
| 2017/0308009 | A1* | 10/2017 | Mochizuki | G03G 15/2039 |

FOREIGN PATENT DOCUMENTS

| | | | |
|---|---|---|---|
| JP | H04-044075 | A | 2/1992 |
| JP | 07129026 | A | 5/1995 |
| JP | 2005345894 | A | 12/2005 |
| JP | 2008304866 | A | 12/2008 |
| JP | 2009042539 | A | 2/2009 |
| JP | 2017219771 | A | 12/2017 |

* cited by examiner

*Primary Examiner* — Thomas S Giampaolo, II
(74) *Attorney, Agent, or Firm* — Venable LLP

(57) ABSTRACT

A fixing unit includes a changing portion configured to change a state of a first rotary member and a second rotary member between a first pressurization state and a second pressurization state. A control portion is configured to control the driving source and the changing unit and capable of performing first control that causes the driving source to rotate the first rotary member and then stop the first rotary member, while continuing the first pressurization state from a last image forming operation, and second control that causes the changing portion to change the state of the first rotary member and the second rotary member from the first pressurization state to the second pressurization state.

23 Claims, 27 Drawing Sheets

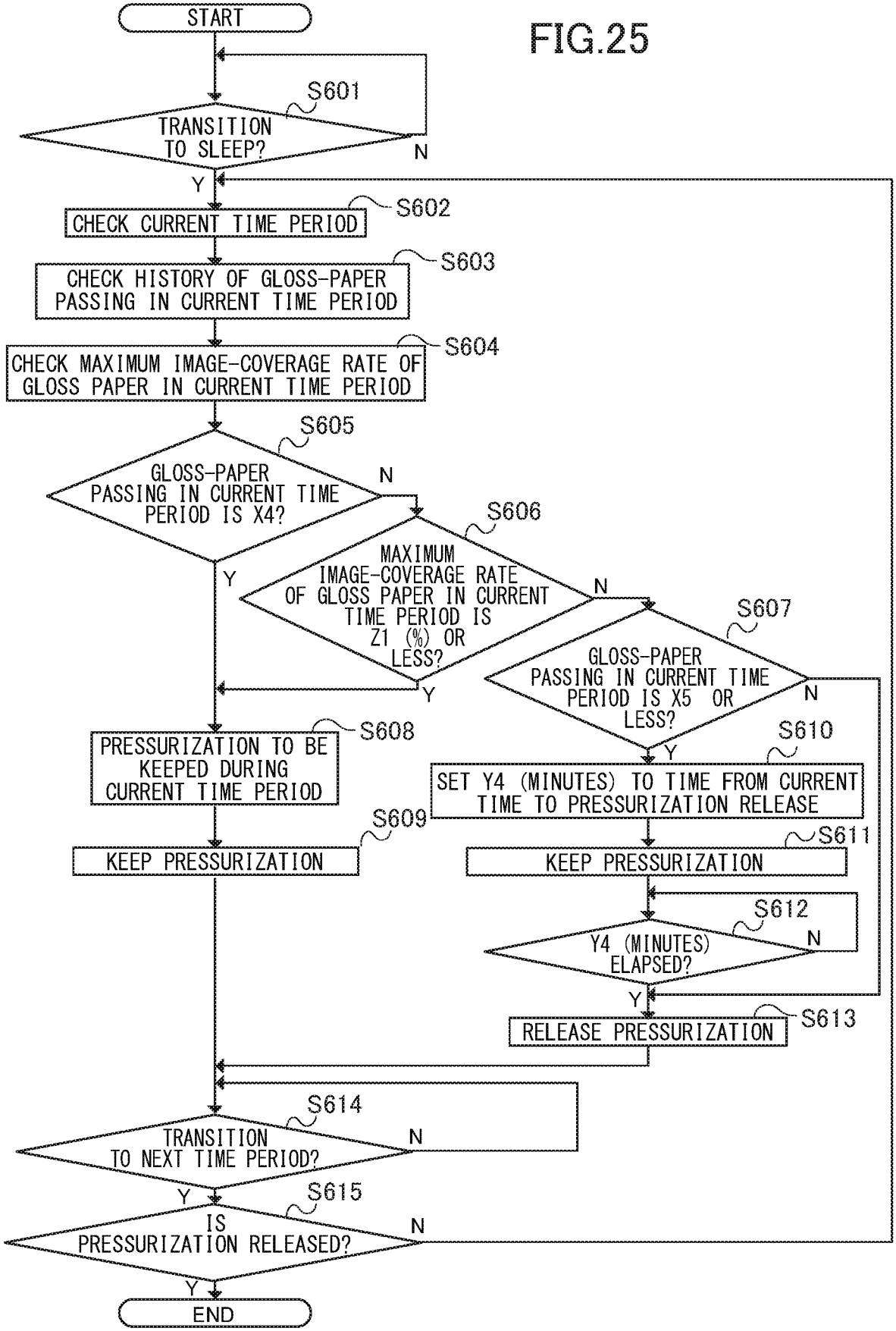
FIG.25
START
S601
TRANSITION TO SLEEP?
N
Y
S602
CHECK CURRENT TIME PERIOD
S603
CHECK HISTORY OF GLOSS-PAPER PASSING IN CURRENT TIME PERIOD
S604
CHECK MAXIMUM IMAGE-COVERAGE RATE OF GLOSS PAPER IN CURRENT TIME PERIOD
S605
GLOSS-PAPER PASSING IN CURRENT TIME PERIOD IS X4?
N
Y
S606
MAXIMUM IMAGE-COVERAGE RATE OF GLOSS PAPER IN CURRENT TIME PERIOD IS Z1 (%) OR LESS?
N
Y
S607
GLOSS-PAPER PASSING IN CURRENT TIME PERIOD IS X5 OR LESS?
N
Y
S608
PRESSURIZATION TO BE KEEPED DURING CURRENT TIME PERIOD
S610
SET Y4 (MINUTES) TO TIME FROM CURRENT TIME TO PRESSURIZATION RELEASE
S609
KEEP PRESSURIZATION
S611
KEEP PRESSURIZATION
S612
Y4 (MINUTES) ELAPSED?
N
Y
S613
RELEASE PRESSURIZATION
S614
TRANSITION TO NEXT TIME PERIOD?
N
Y
S615
IS PRESSURIZATION RELEASED?
N
Y
END

IMAGE FORMING APPARATUS

BACKGROUND OF THE INVENTION

Field of the Invention

The present invention relates to an image forming apparatus that forms images on recording materials.

Description of the Related Art

An electrophotographic image forming apparatus uses a heat-fixing fixing apparatus that fixes a toner image transferred onto a recording material, to the recording material by heating and pressing the toner image. For example, the heat-fixing fixing apparatus uses a fixing film, a guide member that is in contact with an inner circumferential surface of the fixing film, and a pressure roller. The pressure roller abuts against the guide member, via the fixing film, with a predetermined pressing force, so that a nip portion is formed between the fixing film and the pressure roller. However, if the pressure roller is left for a long time while pressed by a pressing force equal to that applied in an image forming operation, a distortion may occur in the pressure roller, causing an image defect (hereinafter referred to as a fixing-set mark).

For reducing the fixing-set mark, Japanese Patent Application Publication No. 2009-042539 describes a technique that releases the pressurization of the pressure roller when the power for the image forming apparatus is shut down. In addition, for preventing the distortion of the pressure roller, Japanese Patent Application Publication No. 2005-345894 describes another technique that rotates the pressure roller at appropriate time intervals in a period of time in which the image forming operation is not performed.

However, if the pressurization of the pressure roller is released as described in Japanese Patent Application Publication No. 2009-042539, it is necessary to perform a pressure-application operation to start applying pressure to the pressure roller before starting the next image forming operation. Thus, when the next image forming operation is instructed after the pressurization is released, a time (FPOT: first-printout time) from when the instruction is received until when the first product is outputted becomes long. On the other hand, Japanese Patent Application Publication No. 2005-345894 can prevent the FPOT from becoming long. However, when the image forming operation is not performed for a long time, the rotation operation of the pressure roller is repeated many times, and the operation sound and the power consumption caused by the rotation operation will be produced.

SUMMARY OF THE INVENTION

The present invention provides an image forming apparatus that can reduce the fixing-set mark and achieve both of shortening the FPOT and suppressing the operation sound and/or the power consumption.

According to one aspect of the invention, an image forming apparatus includes an image forming portion configured to form a toner image on a recording material and a fixing unit including a first rotary member, a second rotary member configured to form a nip portion between the first rotary member and the second rotary member, a changing portion configured to change a state of the first rotary member and the second rotary member between a first pressurization state and a second pressurization state, and a heater configured to heat the toner image on the recording material. The fixing unit is configured to fix the toner image to the recording material on which the toner image has been formed by the image forming portion, by the heater heating the toner image while the recording material being conveyed at the nip portion by the first rotary member and the second rotary member in the first pressurization state. The first pressurization state is a state in which the first rotary member and the second rotary member abut against each other to form the nip portion. The second pressurization state is a state in which pressing force between the first rotary member and the second rotary member is smaller than pressing force in the first pressurization state or a state in which the first rotary member and the second rotary member are separated each other. The image forming apparatus further includes a driving source configured to drive at least one of the first rotary member and the second rotary member, and a control portion configured to control the driving source and the changing portion, and capable of performing first control that causes the driving source to rotate the first rotary member and then stop the first rotary member, while continuing the first pressurization state from a last image forming operation, and second control that causes the changing portion to change the state of the first rotary member and the second rotary member from the first pressurization state to the second pressurization state. In a print stop period from a completion of the last image forming operation to a start of a next image forming operation, the control portion is configured to perform the first control before a number of times of execution of the first control in the print stop period reaches a predetermined number of times, and perform the second control after the number of times of execution of the first control in the print stop period reaches the predetermined number of times.

According to another aspect of the invention, an image forming apparatus includes an image forming portion configured to form a toner image on a recording material and a fixing unit including a first rotary member, a second rotary member configured to form a nip portion between the first rotary member and the second rotary member, a changing portion configured to change a state of the first rotary member and the second rotary member between a first pressurization state and a second pressurization state, and a heater configured to heat the toner image on the recording material. The fixing unit is configured to fix the toner image to the recording material on which the toner image has been formed by the image forming portion, by the heater heating the toner image while the recording material being conveyed at the nip portion by the first rotary member and the second rotary member in the first pressurization state. The first pressurization state is a state in which the first rotary member and the second rotary member abut against each other to form the nip portion. The second pressurization state is a state in which pressing force between the first rotary member and the second rotary member is smaller than pressing force in the first pressurization state or a state in which the first rotary member and the second rotary member are separated each other. The image forming apparatus further includes a driving source configured to drive at least one of the first rotary member and the second rotary member, and a control portion configured to control the driving source and the changing portion, and capable of switching a mode between a first mode in which electric power is supplied for executing an image forming operation and a second mode in which power consumption is less than power consumption in the first mode. In a case of transition from the first mode to the second mode in a print stop period from a completion of a last image forming operation to a start of a next image forming operation, the control portion is configured to select whether to keep the first rotary member and the second rotary member in the first pressurization state continuously from the last image forming operation, or to set the first rotary member and the second rotary member from the first pressurization state to the second pressurization state by the changing portion.

According to still another aspect of the invention, an image forming apparatus includes an image forming portion configured to form a toner image on a recording material and a fixing unit including a first rotary member, a second rotary member configured to form a nip portion between the first rotary member and the second rotary member, a changing portion configured to change a state of the first rotary member and the second rotary member between a first pressurization state and a second pressurization state, and a heater configured to heat the toner image on the recording material. The fixing unit is configured to fix the toner image to the recording material on which the toner image has been formed by the image forming portion, by the heater heating the toner image while the recording material being conveyed at the nip portion by the first rotary member and the second rotary member in the first pressurization state. The first pressurization state is a state in which the first rotary member and the second rotary member abut against each other to form the nip portion. The second pressurization state is a state in which pressing force between the first rotary member and the second rotary member is smaller than pressing force in the first pressurization state or a state in which the first rotary member and the second rotary member are separated each other. The image forming apparatus further includes a driving source configured to drive at least one of the first rotary member and the second rotary member and a control portion configured to control the driving source and the changing portion, and capable of performing first control that causes the driving source to rotate the first rotary member and then stop the first rotary member, while continuing the first pressurization state that has been set in a last image forming operation, and second control that causes the changing portion to change the state of the first rotary member and the second rotary member from the first pressurization state to the second pressurization state. In a print stop period from the completion of the last image forming operation to a start of a next image forming operation, the control portion is configured to perform the first control until an elapsed time from a completion of the last image forming operation reaches a threshold time, and perform the second control after the elapsed time reaches the threshold time.

Further features of the present invention will become apparent from the following description of exemplary embodiments with reference to the attached drawings.

BRIEF DESCRIPTION OF THE DRAWINGS

FIG. 25 is a flowchart for selecting a pressure keeping time in the sixth embodiment.

DESCRIPTION OF THE EMBODIMENTS

Hereinafter, some embodiments of the present invention will be described, as examples, with reference to the accompanying drawings.

First Embodiment

First, an image forming apparatus of a first embodiment will be described. In the first embodiment, when the image forming apparatus transitions to a sleep state, fixing-set mark prevention control is performed. In the fixing-set mark prevention control, an operation to slightly rotate the pressure roller (nip-position change control that serves as first control) and an operation to release the pressurization of the pressure roller (pressure release control that serves as second control) are combined with each other. By the fixing-set mark prevention control, shortening the FPOT and suppressing the operation sound and the power consumption can be both achieved. In particular, in the present embodiment, there is a plurality of types of fixing-set mark prevention control, each defined in advance for a corresponding time period; and one type of the fixing-set mark prevention control is selected in accordance with a time period in which the image forming apparatus transitions to the sleep state, where "a time period" in the present embodiment refers to a time period of a day. Note that in the present embodiment, the description will be made for a case where the FPOT is a time (as known as SFPOT: sleep first-printout time) from when the image forming apparatus returns from the sleep state, until when the first product is outputted.

Configuration of Image Forming Apparatus

Figure 1:
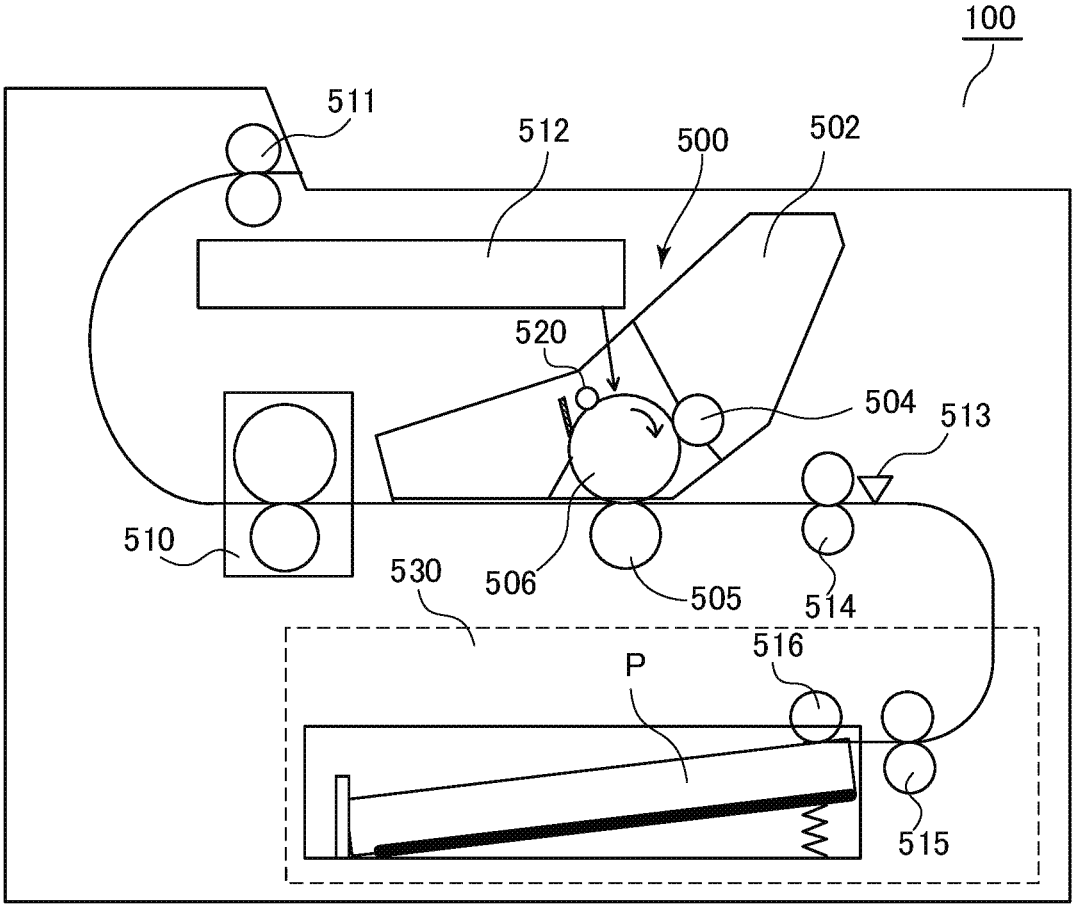
FIG. 1 is a schematic diagram of an image forming apparatus of a first embodiment.

FIG. 1 is a schematic diagram of an image forming apparatus 100 of the present embodiment. A recording material P is stacked on a feeding cassette 530. The recording material P may be a paper sheet, such as a plain paper sheet or a thick paper sheet, a plastic film, a cloth sheet, a sheet material, such as a coated paper sheet, on which certain surface treatment has been performed, a specially-shaped sheet material, such as an envelope or an index paper sheet, or any one of a variety of sheets having different sizes and materials. The recording material P is fed by a feed roller 516, one by one, from a feeding cassette 530 at a predetermined timing, and conveyed to a photosensitive drum 506 by conveyance rollers 515 and 514. The photosensitive drum 506 is an image bearing member. The arrival timing of the recording material P is detected by a registration sensor 513 disposed on a conveyance path of the recording material P.

The image forming apparatus 100 includes an image forming portion 500 that is a direct-transfer electrophotographic unit. The image forming portion is an example of image forming portions. The photosensitive drum 506 rotates in a direction indicated by an arrow. At a predetermined timing, a charging roller 520 is applied with charging bias, and a developing roller 504 is applied with developing bias. The photosensitive drum 506 is uniformly charged by the charging roller 520. A laser scanner unit 512 outputs a laser beam at a predetermined timing. The photosensitive drum 506 is irradiated with the laser beam from the laser scanner unit 512, and an electrostatic latent image is formed on the photosensitive drum 506. A toner container 502 is filled with toner. The toner is supplied onto the photosensitive drum 506 by the rotation of the developing roller 504, and the electrostatic latent image is developed into a toner image. A transfer roller 505 faces the photosensitive drum 506, via the recording material P. The toner image on the photosensitive drum 506 is transferred onto the recording material P by a voltage transfer bias being applied to the transfer roller 505. The voltage transfer bias has a polarity opposite to that of the toner.

The recording material P onto which the toner image has been transferred is heated and pressed in a fixing unit 510 that is a fixing portion, while nipped and conveyed by a roller pair. With this operation, toner particles of the toner image are melted, and solidify and adhere to the recording material P, so that the toner image is fixed to the recording material P. After passing through the fixing unit 510, the recording material P is discharged to the outside of the image forming apparatus 100 by a discharging roller 511.

As described above, the image forming apparatus 100 performs a series of image forming operations (hereinafter referred to as sheet passing) that feeds the recording material P, forms an image on the recording material P, and discharges the recording material P; and thereby outputs a product, on which the image is formed on the recording material. Note that since the above-described image forming portion 500 is one example of the image forming portions, another image forming portion may be used. For example, an intermediate-transfer image forming portion may be adopted, in which a toner image formed on the image bearing member is transferred to the recording material via an intermediate transfer member such as an intermediate transfer belt.

Fixing Unit

Figure 2:
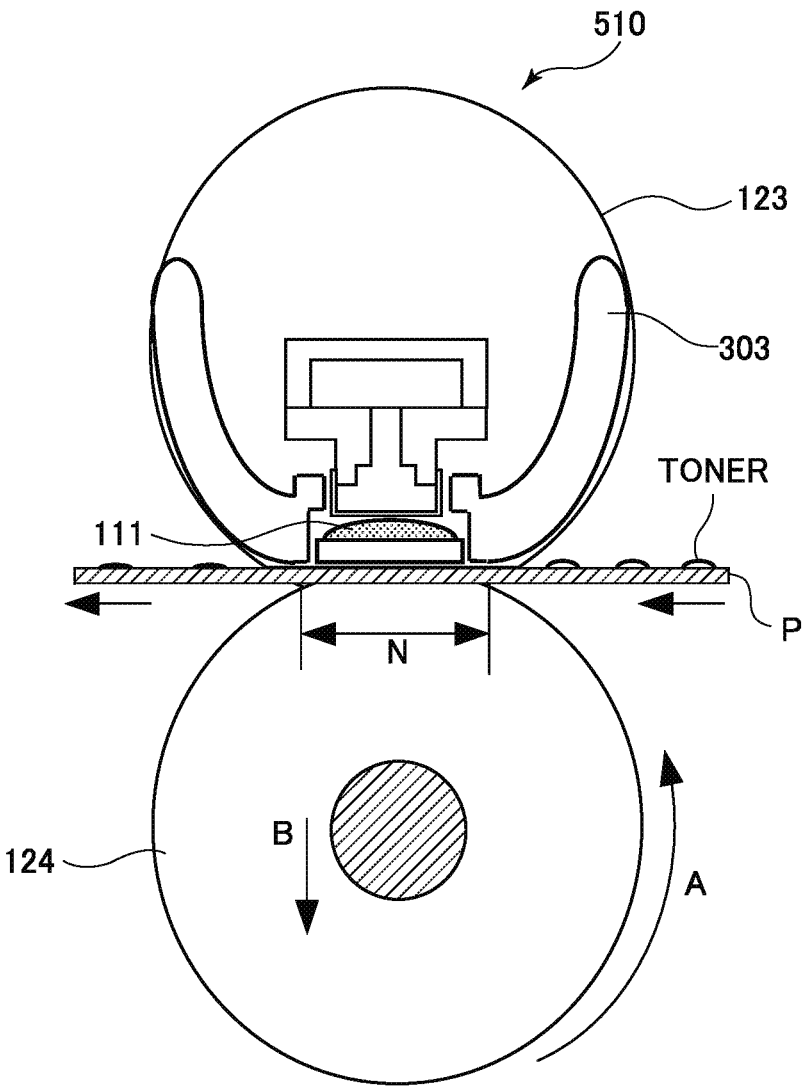
FIG. 2 is a schematic diagram of a fixing unit of the first embodiment.

FIG. 2 is a schematic diagram of a fixing unit 510. The fixing unit 510 is a film-heating type heating apparatus described, for example, in Japanese Patent Application Publication No. H04-44075, and has an endless film (cylindrical film) and drives the pressure roller. The fixing unit 510 includes a fixing heater 111 that serves as a heater, a heater holder 303 that holds the fixing heater 111, a pressure roller 124 that serves as a first rotary member, and a fixing film 123 that serves as a second rotary member.

The fixing film 123 is a cylindrical heat-resistant film, and is externally and loosely fitted to the heater holder 303, to which the fixing heater 111 is attached. The heater holder 303 is a guide member that has heat resistance and rigidity, and that has a guide surface that is semicircular-arc-shaped when viewed in a longitudinal direction of the fixing unit 510 (i.e., rotation-axis direction of the pressure roller 124). In addition, the heater holder 303 is formed like a tub, and a concave portion to accommodate the fixing heater 111 is formed in a surface of the tub that faces the pressure roller 124. The pressure roller 124 is in pressure contact with the fixing heater 111, via the fixing film 123; and forms a fixing nip portion N as a nip portion.

The fixing film 123 has three layers of a base layer, a rubber layer, and a surface layer disposed in this order in a direction from the inner circumferential side toward the outer circumferential side of the fixing film 123. For example, the base layer of the fixing film 123 is made of polyimide resin, the rubber layer is made of silicone rubber, and the surface layer is made of fluororesin such as PFA: perfluoroalkoxy alkane. The pressure roller 124 includes a core metal, a rubber layer, and a surface layer disposed in this order in a direction from the center (axis) toward the outer circumference of the pressure roller 124. For example, the core metal of the pressure roller 124 is made of metal such as stainless steel or aluminum, the rubber layer is made of silicone rubber, and the surface layer is made of fluororesin such as PFA. The pressure roller 124 is driven and rotated by a fixing motor, which serves as a driving source, toward a direction indicated by an arrow A (counterclockwise in FIG. 2) at a predetermined circumferential speed.

Figure 3:
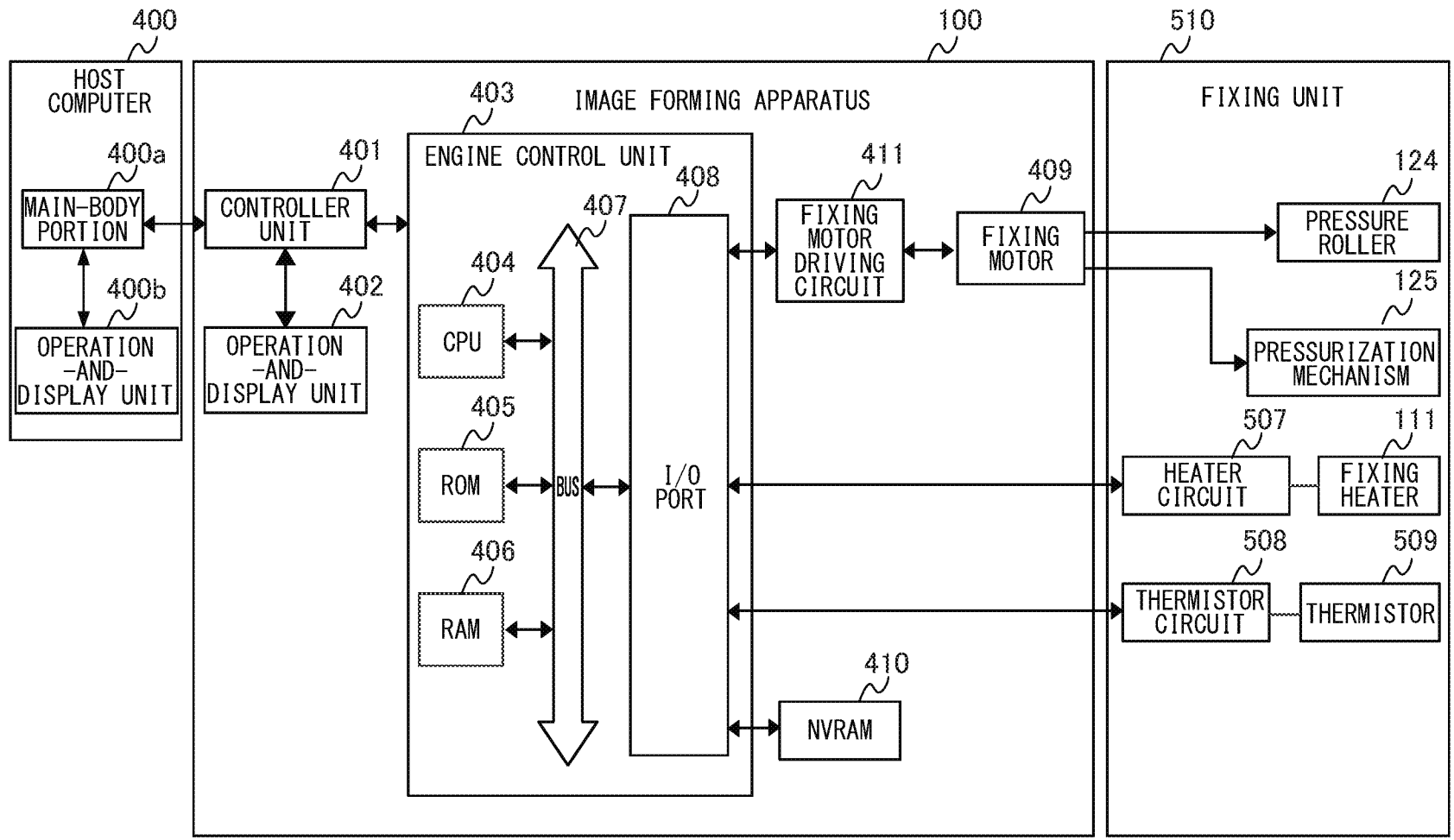
FIG. 3 is a hardware configuration diagram of the image forming apparatus of the first embodiment.

The fixing unit 510 also includes a pressurization mechanism 125 (FIG. 3). The pressurization mechanism 125 serves as a changing portion that changes a pressurization state (fixing-pressure application state) of the pressure roller 124 and the fixing film 123, and moves the pressure roller 124 toward a direction indicated by an arrow B. For example, the pressurization mechanism 125 may be a cam mechanism, which is driven by the fixing motor and moves a bearing member of the pressure roller 124 toward a direction (i.e., vertical direction in FIG. 2) in which the bearing member is moved closer to or away from the heater holder 303. By the pressurization mechanism 125 moving the pressure roller 124, the state of the pressure roller 124 and the fixing film 123 is changed between a first pressurization state (normal pressure-application state in an image forming operation) and a second pressurization state (pressure release state). The first pressurization state is a state in which a toner image is fixed in image formation. In this state, the pressure roller 124 is in pressure contact with the fixing heater 111, via the fixing film 123, at an appropriate contact pressure; and forms the fixing nip portion N. The second pressurization state is a state in which the pressurization of the pressure roller 124 to the fixing film 123 is released. In this state, the contact pressure between the pressure roller 124 and the fixing film 123 is smaller than that in the first pressurization state. Note that the second pressurization state includes a state in which the pressure roller is separated from the fixing film 123 and the contact pressure is zero. Instead of moving the pressure roller 124 for setting the pressure release state, a component (heater 111 or heater holder 303) for the fixing film 123 may be moved with respect to the pressure roller 124 for removing the pressure.

Hardware Configuration of Image Forming Apparatus

FIG. 3 is a hardware configuration diagram in the present embodiment. A hardware configuration of the present embodiment includes a host computer 400 and the image forming apparatus 100. The host computer 400 includes a main-body portion 400*a* and an operation-and-display unit 400*b*. The main-body portion 400*a* instructs the image forming apparatus 100 to perform a print operation, via a network. The operation-and-display unit 400*b* of the host computer 400 includes a display, a keyboard, and a mouse (not illustrated).

The image forming apparatus 100 includes a controller unit 401, an operation-and-display unit 402, and an engine control unit 403. The operation-and-display unit 402 of the image forming apparatus 100 includes a display device such as an operation panel, and an input device such as operation buttons. The controller unit 401 sends print data and a print operation instruction, sent from the host computer 400, to the engine control unit 403. The engine control unit 403 includes a CPU 404, a ROM 405, a RAM 406, a bus 407, and an I/O port 408. The CPU 404 executes a program by loading the program or various data from the ROM 405, and using the RAM 406 as a work area.

A control circuit of the engine control unit 403 serves as a control portion of the present embodiment that controls the operation of the image forming apparatus 100. The CPU 404 is an example of an execution unit that operates the image forming apparatus in a certain manner by executing a program. The ROM 405 is an example of a non-transitory storage medium that stores such a program and data necessary to execute the program.

The fixing unit 510 includes the fixing film 123, a heater circuit 507, the fixing heater 111, a thermistor circuit 508, and a thermistor 509. The I/O port 408 is connected with the fixing motor 409, a fixing-motor driving circuit 411, an NVRAM 410, the heater circuit 507, and the thermistor circuit 508. The CPU 404 outputs a signal to the fixing-motor driving circuit 411 via the bus 407 and the I/O port 408, and thereby drives and rotates the fixing motor 409. When the CPU 404 rotates the fixing motor 409 in a forward direction, the pressure roller 124 is driven and rotated, and thereby the fixing film 123 rotates together with the fixing motor 409, in a forward direction. When the CPU 404 rotates the fixing motor 409 in a reverse direction, the driving force of the fixing motor 409 is transmitted to the pressurization mechanism 125, and the pressurization mechanism 125 changes the pressurization state of the fixing film 123 and the pressure roller 124. In addition, the CPU 404 outputs a signal to the heater circuit 507 via the bus 407 and the I/O port 408, and thereby heats the fixing heater 111. In addition, the CPU 404 receives a signal from the thermistor 509, via the bus 407, the I/O port 408, and the thermistor circuit 508. In addition, the CPU 404 reads/writes nonvolatile data from/to the NVRAM 410, via the bus 407 and the I/O port 408.

Functional Block in First Embodiment

Figure 4:
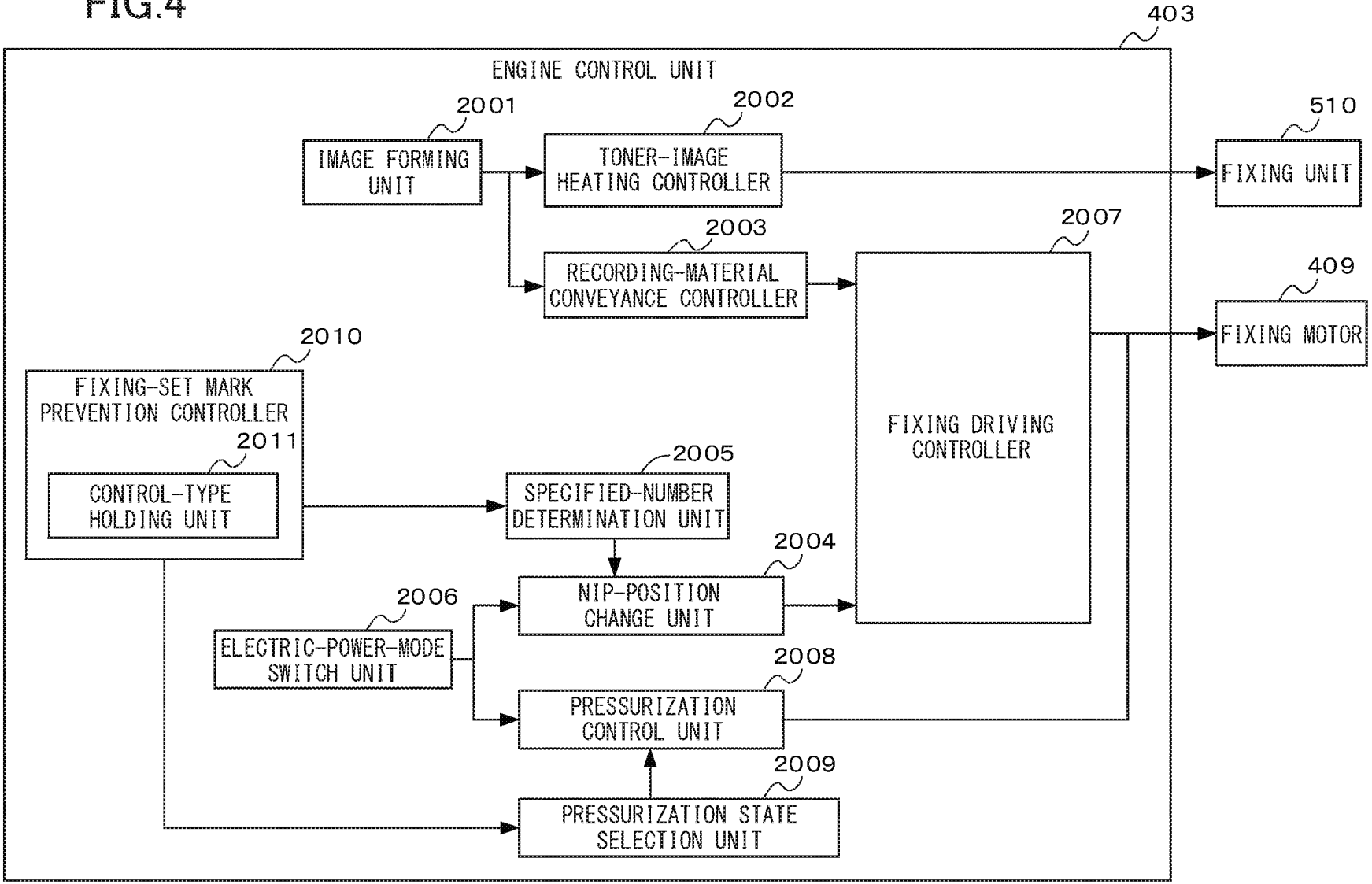
FIG. 4 is a functional block diagram in the first embodiment.

Functions of the engine control unit 403 will be described with reference to the functional block diagram of FIG. 4. The functions of the engine control unit 403 are executed by the CPU 404 in accordance with a program stored in the ROM 405 and data stored in the RAM 406.

The engine control unit 403 includes an image-forming control portion 2001 that has functions for forming images. The image-forming control portion 2001 determines image-forming conditions, such as a speed of feeding and conveying operations, a transfer voltage value, and a fixing temperature, in accordance with a type (hereinafter referred to as a sheet type) of the recording material; and manages the execution of the electrophotographic process performed by the image forming portion 500. In addition, the image-forming control portion 2001 instructs a toner-image heating controller 2002 to perform a heating operation, and a recording-material conveyance controller 2003 to perform a conveyance operation. The toner-image heating controller 2002 performs temperature control on the fixing unit 510, depending on the instruction by the image-forming control portion 2001. That is, the toner-image heating controller 2002 compares a current temperature obtained from the thermistor circuit 508 (FIG. 3) with a target temperature specified in the heating instruction, and outputs a signal that causes the fixing film 123 to have the target temperature, to the heater circuit 507 (FIG. 3). The recording-material conveyance controller 2003 instructs a fixing driving controller 2007 to convey a recording material, depending on the conveyance instruction from the image-forming control portion 2001. The fixing driving controller 2007 instructs the fixing motor 409 to control the rotation of the fixing film.

The engine control unit 403 also includes a fixing-set mark prevention controller 2010 and a control-type holding unit 2011 that have functions for fixing-set mark prevention control. The fixing-set mark prevention controller 2010 refers to the information held by the control-type holding unit 2011, and determines a type of the fixing-set mark prevention control in accordance with a time period in which the sheet passing is performed. In addition, in accordance with the determined type of the fixing-set mark prevention control, the fixing-set mark prevention controller 2010 instructs a specified-number determination unit 2005 and a pressurization-state selection unit 2009 to appropriately perform the fixing-set mark prevention control.

The engine control unit 403 also includes an electric-power-mode switch unit 2006 that has functions for switching electric-power mode. The electric-power-mode switch unit 2006 selects modes of the image forming apparatus 100 from a plurality of modes including a normal-power mode and a power-saving mode, and switches between the selected modes. The normal-power mode is a mode in which the electric power necessary for forming images is supplied, and the power-saving mode is a mode in which the power consumption is less than that in the normal-power mode. The normal-power mode is a first mode of the present embodiment, and the power-saving mode is a second mode of the present embodiment.

In the transition to the power-saving mode, the electric-power-mode switch unit 2006 sends a change start instruction to a nip-position change unit 2004, and a pressure application/release instruction to a pressurization control unit 2008. Upon receiving the instruction from the electric-power-mode switch unit 2006, the nip-position change unit 2004 performs an operation to change a fixing nip position (the operation is first control of the present embodiment, and hereinafter referred to as nip-position change control) by the number (specified number) of times determined by a specified-number determination unit 2005. Specifically, the nip-position change unit 2004 sends an instruction to the fixing driving controller 2007 for causing the fixing driving controller 2007 to slightly rotate the fixing film 123 and the pressure roller 124 at predetermined intervals. With this operation, a portion of the outer circumferential surface of the fixing film 123 that has been located in the fixing nip portion moves away from the fixing nip portion, and another portion of the outer circumferential surface of the fixing film 123 is newly located in the fixing nip portion. Similarly, a portion of the outer circumferential surface of the pressure roller 124 that has been located in the fixing nip portion moves away from the fixing nip portion, and another portion of the outer circumferential surface of the pressure roller 124 is newly located in the fixing nip portion. Upon receiving the instruction from the electric-power-mode switch unit 2006, the pressurization control unit 2008 sends a driving signal to the fixing motor 409, and causes the fixing unit 510 to transition to either the first pressurization state or the second pressurization state, selected by the pressurization-state selection unit 2009.

Description for Fixing-Set Mark Prevention Control of First Embodiment

If the image forming apparatus has been left in the pressurization state (first pressurization state) in which the fixing nip portion N is formed, for a long time, deformation caused by the pressurization in the fixing nip portion N is left on the pressure roller 124, as history, and causes distortion of the pressure roller 124. The distortion locally decreases pressing force of the pressure roller 124, causing insufficient heating and unstable conveyance speed of a heated material. As a result, the fixing-set mark that is an image defect occurs. Such deformation caused by the pressurization, which leads to the image defect, may occur in the fixing film 123.

For this reason, the present embodiment performs the fixing-set mark prevention control in which the operation to release the pressure applied in the fixing nip portion (second control in the present embodiment that is hereinafter referred to as pressure release control) and the nip-position change control are combined. The nip-position change control slightly rotates the pressure roller 124 while keeping the pressurization state that has been set in the sheet passing. Note that the nip-position change control in the present embodiment is repeated at preset constant intervals up to the specified number of times determined by the specified-number determination unit 2005. The interval time of an example of the configuration described below is 10 minutes.

Figure 5:
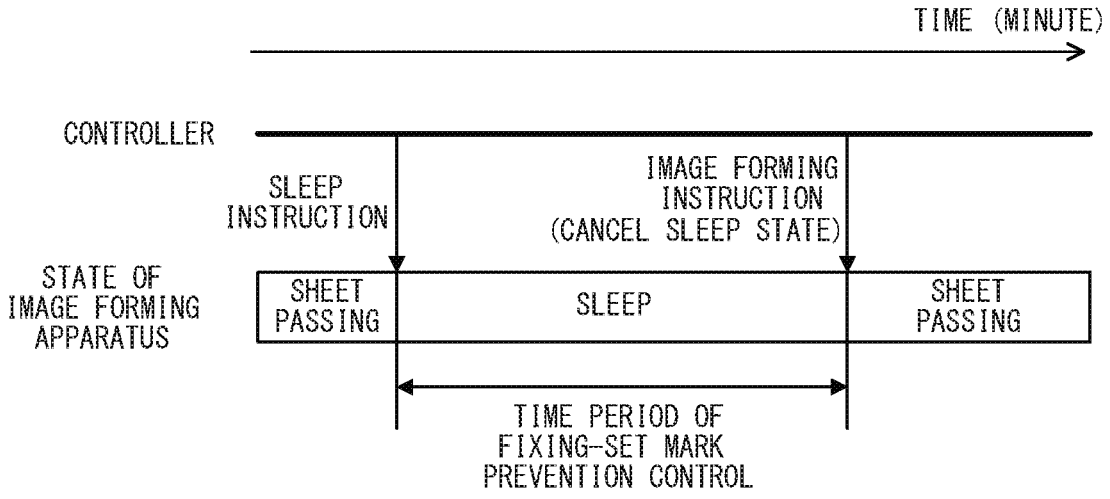
FIG. 5 is a diagram for illustrating a time period of fixing-set mark prevention control of the first embodiment.

As illustrated in FIG. 5, the trigger to start the fixing-set mark prevention control is, for example, a sleep instruction for the transition to the power-saving mode. The sleep instruction is performed mainly by the controller unit 401. In addition, it is common in the recent energy-saving trend that the sleep instruction is performed immediately after the completion of sheet passing. In general, the condition on sleep cancellation is an instruction for executing a new image-forming operation (sheet passing request).

Note that the two types of control (pressure release control and nip-position change control) used in the fixing-set mark prevention control each have a merit and a demerit. That is, if the pressure in the fixing unit 510 is released by the pressure release control, the operation to prevent the fixing-set mark is unnecessary in the sleep state, but the pressure is applied again when the image forming apparatus returns from the sleep state. As a result, the SFPOT increases. On the other hand, if the nip-position change control is performed in the sleep state, the increase in the SFPOT can be avoided, but the operation sound and/or the power consumption increases in the sleep state.

That is, if it is known that the image forming apparatus has a high operation rate, and that even if the image forming apparatus transitions to a sleep state, a next sheet passing request is made after a stop period that is short to some extent, it is advantageous to prevent the fixing-set mark by performing the nip-position change control, without performing the pressure release control. This is because in this case, many users can get a short SFPOT, which is a merit of the nip-position change control. In contrast, if the image forming apparatus has a low operation rate and the sleep period is long, performing the pressure release control can minimize the operation sound and the power consumption.

Thus, in the present embodiment, the nip-position change control is performed in the sleep state, and the pressure release control is performed if the number of times of execution of the nip-position change control in the sleep state reaches a specified number of times. Since the nip-position change control is performed until the specified number of times is reached, a short SFPOT can be achieved for a case where the image forming apparatus has a high operation rate. In addition, it is expected that when the number of times of execution of the nip-position change control reaches the specified number of times, the sleep period will continue for a long time. Thus, the pressure release control is performed to minimize the operation sound and the power consumption.

Figure 6A:
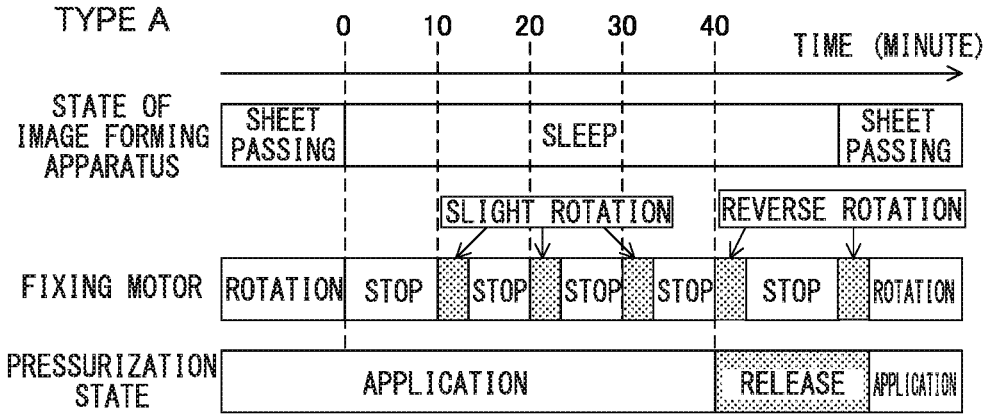
FIG. 6A illustrates a sequence of operations of the fixing-set mark prevention control of the first embodiment.
Figure 6B:
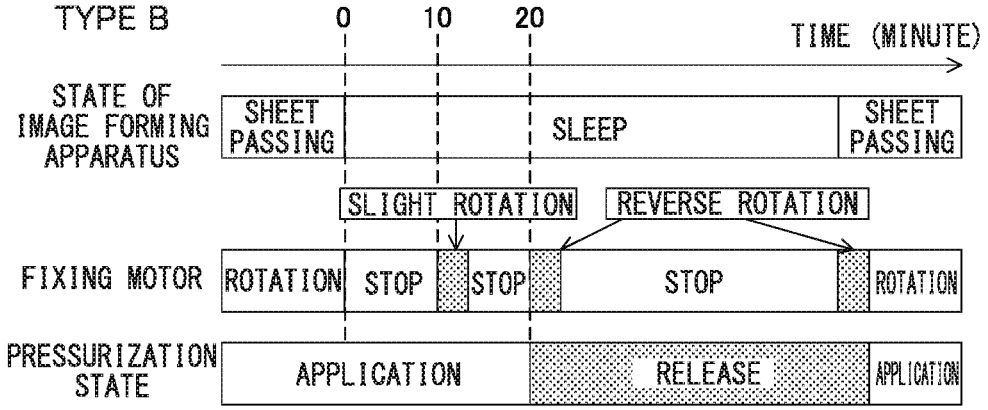
FIG. 6B illustrates a sequence of operations of the fixing-set mark prevention control of the first embodiment.
Figure 6C:
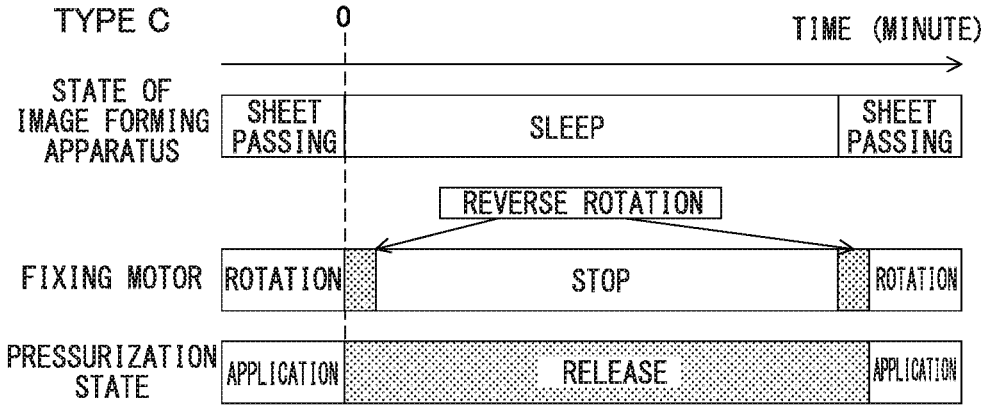
FIG. 6C illustrates a sequence of operations of the fixing-set mark prevention control of the first embodiment.

Furthermore, for further optimizing the fixing-set mark prevention control, the present embodiment selectively performs one of three types of the fixing-set mark prevention control, depending on a time period. As shown in Table 1, the three types of fixing-set mark prevention control have different specified numbers of times of the nip-position change control. FIGS. 6A to 6C each specifically illustrate a sequence of operations of a corresponding type of the fixing-set mark prevention control. In each of FIGS. 6A to 6C, an upper portion illustrates an operation state of the whole of the image forming apparatus, a middle portion illustrates an operation state of the fixing motor, and a lower portion illustrates a pressurization state in the fixing nip.

TABLE 1

| TYPE | CONTENTS | FEATURE |
|---|---|---|
| A | NIP-POSITION CHANGE CONTROL IS PERFORMED EVERY 10 MINUTES IN SLEEP STATE. PRESSURE RELEASE CONTROL IS PERFORMED WHEN NIP-POSITION CHANGE CONTROL HAS BEEN PERFORMED FOUR TIMES. | PRECEDENCE OF SFPOT |

TABLE 1-continued

| TYPE | CONTENTS | FEATURE |
|---|---|---|
| B | NIP-POSITION CHANGE CONTROL IS PERFORMED EVERY 10 MINUTES IN SLEEP STATE. PRESSURE RELEASE CONTROL IS PERFORMED WHEN NIP-POSITION CHANGE CONTROL HAS BEEN PERFORMED TWO TIMES. | INTERMEDIATE BETWEEN TYPE A AND TYPE C |
| C | PRESSURE RELEASE CONTROL IS PERFORMED SIMULTANEOUSLY WITH SLEEP INSTRUCTION. | PRECEDENCE OF OPERATION SOUND AND POWER CONSUMPTION |

In a type A (FIG. 6A) of the fixing-set mark prevention control, the specified number of times is four, and the pressure release control is performed at the fourth timing of execution of the nip-position change control. Note that the fourth timing of execution of the nip-position change control means a start time of the fourth nip-position change control in a case where the nip-position change control is assumed to be repeated at and after the fourth nip-position change control. Thus, the maximum number of times of actual execution of the nip-position change control is three. That is, in the type A of the fixing-set mark prevention control, if the stop period of sheet passing (i.e., print stop period in which no image forming operation is performed, and which is hereinafter referred simply to as a stop period) continues even after the predetermined number (three, in this case) of times of nip-position change control (i.e., first control) are performed, the pressure release control (i.e., second control) is performed. Thus, in the type A of the control, if the next image forming request is not made when 40 minutes has passed since the completion of the last sheet passing, the pressure release control is performed. In the type A, many users can get a short SFPOT in a time period in which it is expected that the image forming apparatus has a high operation rate (in general, the operation rate is obtained by dividing a time period from a start time to an end time, by a rest time).

In a type C (FIG. 6C), the pressure release control is performed simultaneously with the sleep instruction. That is, the pressure release control is performed in a case where the specified number of times is zero. The type C is suitably selected to minimize the operation sound and the power consumption in a time period in which the image forming apparatus has a low operation rate (in general, the time period is a time late at night or a break time).

In a type B (FIG. 6B), the specified number of times is two, and the pressure release control is performed at the second timing of execution of the nip-position change control. That is, in the type B of the fixing-set mark prevention control, if the stop period of sheet passing continues even after the predetermined number (one, in this case) of time of nip-position change control (first control) is performed, the pressure release control (second control) is performed. In this case, if the next image forming request is not made when twenty minutes has passed since the completion of the last sheet passing, the pressure release control is performed. The type B plays an intermediate role between the type A and the type C, and is suitably selected for a time period in which the image forming apparatus has a medium operation rate, or in which the operation rate varies significantly depending on days.

Method of Selecting Fixing-Set Mark Prevention Control in First Embodiment

In the present embodiment, the type of the fixing-set mark prevention control is preset in accordance with a time period as shown in Table 2, and the image forming apparatus selects a type of the fixing-set mark prevention control from Table 2 in accordance with a timing at which the image forming apparatus transitions to the sleep state. In the present embodiment, twenty-four hours are divided into twenty-four units each having one hour. For example, a time period 1 denotes a time period of 1, that is, a time period between 0:00 and 1:00. In addition, the information shown in Table 2 is prestored, for example, in the ROM 405 of the engine control unit 403.

TABLE 2

| TIME PERIOD | 1 | 2 | ... | 8 | 9 | 10 | 11 | 12 | 13 | 14 | 15 | 16 | 17 | 18 | 19 | ... | 23 | 24 |
|---|---|---|---|---|---|---|---|---|---|---|---|---|---|---|---|---|---|---|
| CONTROL TYPE | C | C | | B | A | A | A | B | A | A | A | A | A | B | C | | C | C |

Figure 7:
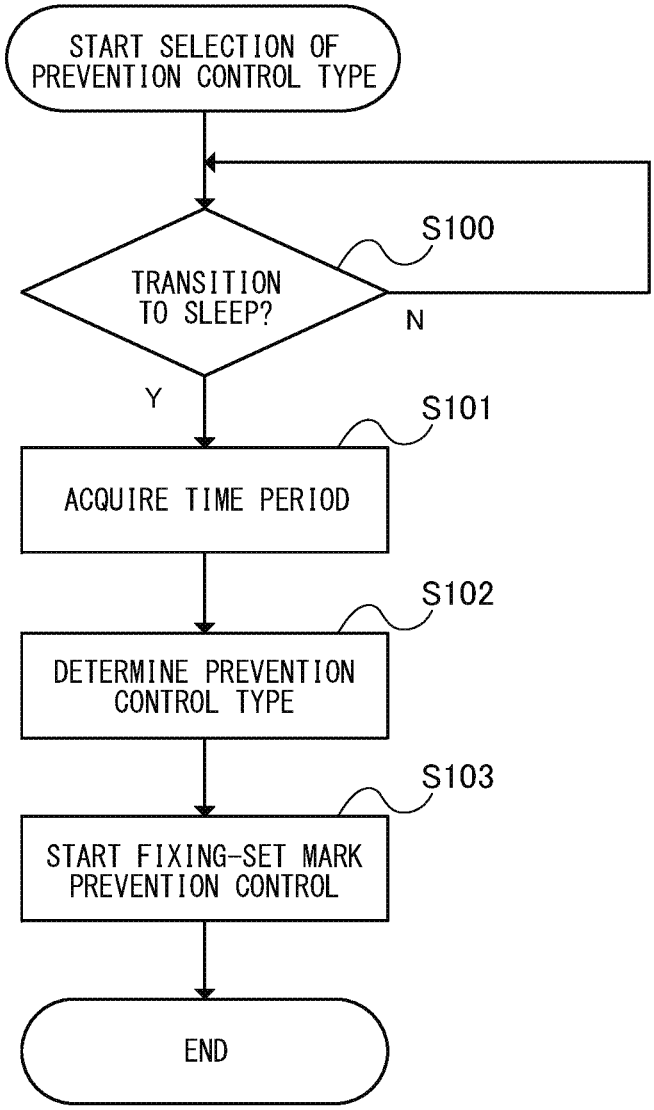
FIG. 7 is a flowchart of the fixing-set mark prevention control of the first embodiment.

FIG. 7 is a flowchart that illustrates an example of control to select a type of the fixing-set mark prevention control. When the image forming apparatus transitions to the sleep state, the specified-number determination unit 2005 and the pressurization-state selection unit 2009 obtain a current time period (S100, S101), determine a type of the prevention control in accordance with Table 2 (S102), and start the type of the fixing-set mark prevention control (S103).

As described above, in the present embodiment, when the image forming apparatus transitions to the sleep state, one type of the fixing-set mark prevention control that is preset in accordance with a corresponding time period is selected and executed. That is, when the image forming apparatus transitions from the normal-power mode to the power-saving mode in a stop period of image formation, the fixing unit is kept in the first pressurization state that has been set in the last sheet passing (type A, B), or otherwise the pressurization state of the fixing unit is changed from the first pressurization state to the second pressurization state (type C). With this operation, the merit of shortening the SFPOT and suppressing the operation sound and the power consumption can be achieved. Note that the control performed by each type of the fixing-set mark prevention control is not limited to the control described in the present embodiment. For example, the interval time and the specified number of times, which is an upper limit, for performing the nip-position change control may be optimized in accordance with requirements or limitations of the image forming apparatus.

In addition, the start trigger for the fixing-set mark prevention control is not limited to the transition to the sleep state, and may be the completion of a print operation or may be a timing at which a predetermined time has elapsed since the transition to the sleep state. Thus, the start trigger can be optimized in accordance with requirements or limitations of the image forming apparatus. That is, the fixing-set mark prevention control of the present embodiment can be applied in at least one portion of the stop period from the completion of the last sheet passing in the image forming apparatus, to the start of the next sheet passing.

First Modification

The pressure release control may be performed depending on an elapsed time from the completion of sheet passing, instead of the set value (specified number of times) that is an upper limit of the number of times of the nip-position change control as descried in the first embodiment. For example, in the type A of the fixing-set mark prevention control, the nip-position change control is performed in a time period from when a sheet passing completes, until when a threshold time (for example, 40 minutes) elapses; and the pressure release control is performed after the 40 minutes have elapsed. In this case, the time setting of 40 minutes (that is a time period in which the first pressurization state is kept after the completion of sheet passing) may be stored in a storage medium such as a ROM, instead of the specified number of times, and the time setting may be read by the CPU when the CPU executes the fixing-set mark prevention control. Also in such a case, like the operation of the type A of the first embodiment, since the pressure release control is performed when the stop period of image formation is continued even after the nip-position change control is performed the predetermined number (three) of times after the completion of sheet passing, the same merit as that of the first embodiment can be obtained.

Second Modification

In the first embodiment, the description has been made for the configuration that uses an endless fixing film as a fixing member. However, the present embodiment is also effective in cases where the second rotary member is a fixing roller having an elastic layer, and where both of the first rotary member and the second rotary member are endless films or belts. This is because also in these cases, the deformation caused by the pressurization that leads to the fixing-set mark may occur in at least one of the first rotary member and the second rotary member, and the fixing-set mark prevention control of the present embodiment can reduce the fixing-set mark and achieve both of shortening the SFPOT and suppressing the operation sound and the power consumption.

Second Embodiment

A second embodiment uses a method of analyzing a trend of operating conditions of the image forming apparatus from the history of operations of the image forming apparatus, and changing the type of the fixing-set mark prevention control in accordance with a time period. With this method, the optimum SFPOT, operation sound, and power consumption can be obtained. Hereinafter, the same description as that for the first embodiment will be omitted, and the description will be made, with a component having substantially the same structure and operation as a component of the first embodiment being given the same reference symbol.

Functional Block in Second Embodiment

Figure 8:
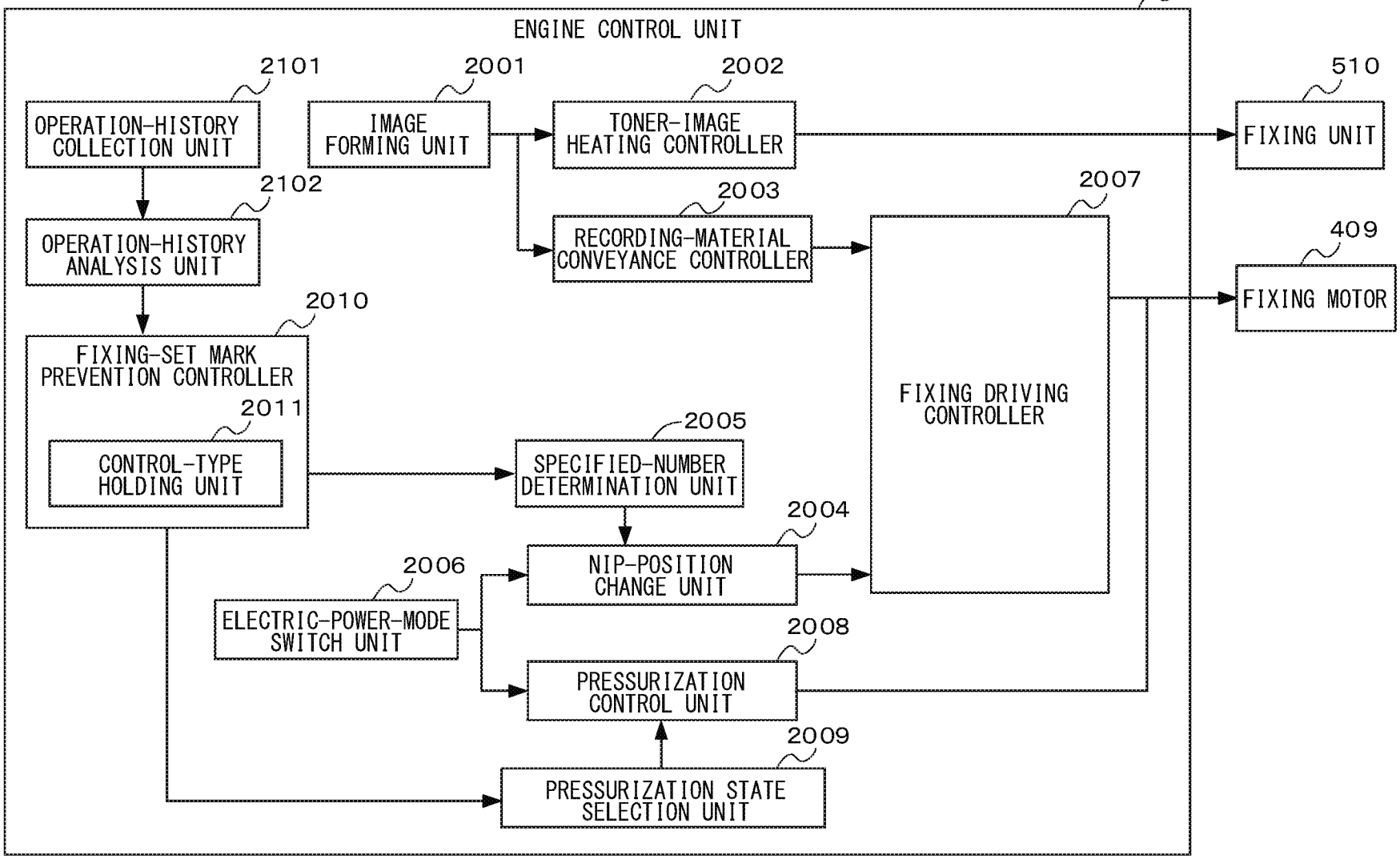
FIG. 8 is a functional block diagram in a second embodiment.

As illustrated in a functional block diagram of FIG. 8, an engine control unit 403 of the present embodiment includes an operation-history collection unit 2101 and an operation-history analysis unit 2102 that have functions on a history of operations of the image forming apparatus. The operation-history collection unit 2101 collects a history of operations of the image forming apparatus, and records the history into the RAM 406. The operation-history analysis unit 2102 extracts and processes the recorded history of operations, and records an operation-history analysis result into the RAM 406. The specified-number determination unit 2005 determines the specified number of times in accordance with the operation-history analysis result. In addition, the pressurization-state selection unit 2009 selects a pressurization state in accordance with the operation-history analysis result.

Method of Selecting Fixing-Set Mark Prevention Control in Second Embodiment

In the present embodiment, since the type of the fixing-set mark prevention control is changed in accordance with the operating conditions of the image forming apparatus, it is necessary to accumulate data on the operating conditions of the image forming apparatus and estimate an optimum type of the fixing-set mark prevention control for a certain time period.

First, a method of accumulating data on the operating conditions will be described. Specifically, a stop time S (minute) between jobs is defined for each time period (one hour) of a day of the week, the day of last week, and the day before the last week (i.e., days of past three weeks). If a sample number is denoted by n (1: two weeks ago, 2: one week ago, 3: current day), a day of the week is denoted by day (1: Monday, 2: Tuesday, . . . , 7: Sunday), and a time period is denoted by time (1: 1:00, 2: 2:00, . . . , 24: 24:00), the stop time is expressed by S(n, day, time). Since the stop time S(n, day, time) is an average length of stop times of each time period (the image forming apparatus did not operate in the stop times), the stop time S(n, day, time) is expressed by following Equation 1. In Equation 1, the time in which the image forming apparatus was operated is denoted by t, and the number of jobs processed is denoted by job.

$$S(n, \text{day}, \text{time}) = \frac{(60 - t)}{\text{job}} \qquad \text{Equation 1}$$

In the equation, if job=0, S=60.

Finally, by averaging the stop times of the past three weeks as expressed in following Equation 2, an average stop time S_ave(day, time) in the time period of the day of the week can be obtained.

$$S_{ave}(\text{day}, \text{time}) = \left\{\sum_{n=1}^{3} S(n, \text{day}, \text{time})\right\} \Big/ 3 \qquad \text{Equation 2}$$

Figure 9:
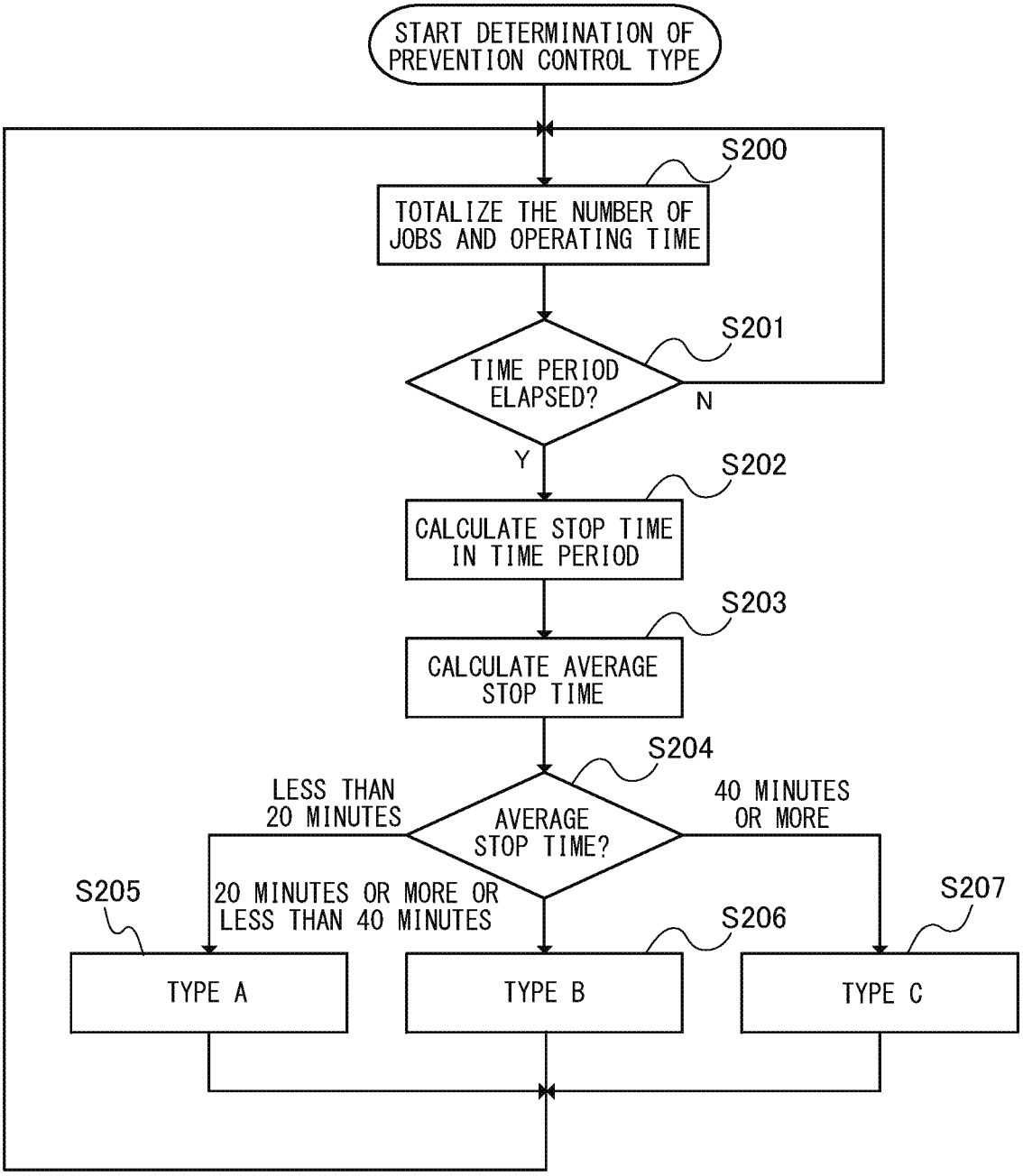
FIG. 9 is a flowchart illustrating a type determination process for fixing-set mark prevention control of the second embodiment.

Next, with reference to FIG. 9 and Table 3, processes of the flowchart to calculate the average stop time S_ave will be described. In the present embodiment, since the time period is defined as a unit of one hour, the operation-history collection unit 2101 continues to count the number of jobs and the operating time until the time period of one hour elapses (S200, S201). When the time period has elapsed, the operation-history analysis unit 2102 uses Equation 1 and calculates the stop time S in the time period. In addition, by using the two stop times stored in the past, the operation-history analysis unit 2102 updates the average stop time S_ave in the time period (S202, S203).

Finally, by using the average stop time S_ave, the type of the fixing-set mark prevention control held by the control-type holding unit 2011 is updated. In the present embodiment, if the average stop time is less than 20 minutes, the operation rate is determined as a high operation rate, and the type A of Table 1 is set. In contrast, if the average stop time is equal to or larger than 40 minutes, the operation rate is determined as a low operation rate, and the type C is set. In addition, if the average stop time is equal to or larger than 20 minutes and smaller than 40 minutes, the type B is set (S204, S205, S206, and S207). If a history of operations on a certain day of the week is one as shown in Table 3, a type of the fixing-set mark prevention control for each time period of the day is set as illustrated in the bottom row of Table 3.

TABLE 3

| TIME PERIOD | 1 | 2 | ... | 8 | 9 | 10 | 11 | 12 | 13 | 14 | 15 | 16 | 17 | 18 | 19 | ... | 23 | 24 |
|---|---|---|---|---|---|---|---|---|---|---|---|---|---|---|---|---|---|---|
| NUMBER OF JOBS | 0 | 0 | | 1 | 5 | 4 | 4 | 2 | 6 | 5 | 4 | 3 | 4 | 2 | 1 | | 0 | 0 |
| OPERATING TIME [MINUTE] | 0 | 0 | | 1 | 5 | 3 | 4 | 1 | 6 | 3 | 3 | 2 | 4 | 1 | 2 | | 0 | 0 |
| STOP TIME (DAY OF WEEK) [MINUTE] | 60 | 60 | | 59 | 11 | 14 | 14 | 30 | 9 | 11 | 14 | 19 | 14 | 30 | 58 | | 60 | 60 |
| STOP TIME (DAY OF LAST WEEK) [MINUTE] | 60 | 60 | | 40 | 12 | 15 | 13 | 40 | 7 | 10 | 20 | 20 | 12 | 40 | 55 | | 60 | 60 |
| STOP TIME (DAY BEFORE LAST WEEK) [MINUTE] | 60 | 60 | | 55 | 20 | 9 | 12 | 32 | 6 | 15 | 30 | 15 | 18 | 25 | 40 | | 60 | 60 |
| AVERAGE STOP TIME [MINUTE] | 60 | 60 | | 51 | 14 | 13 | 13 | 34 | 7 | 12 | 21 | 18 | 15 | 32 | 51 | | 60 | 60 |
| CONTROL TYPE | C | C | | B | A | A | A | B | A | A | A | A | A | B | C | | C | C |

When the image forming apparatus transitions to a sleep state, a type of the fixing-set mark prevention control is determined by referring to the information on the state updated as described above in accordance with the history of operations. That is, when the image forming apparatus transitions to the sleep state, the nip-position change unit 2004 and the pressurization control unit 2008 select a type of the fixing-set mark prevention control that corresponds to a current time period, from the control type for each time period held by the control-type holding unit 2011; and operate in accordance with the selected type.

As described above, in the fixing-set mark prevention control of the second embodiment, since the control type is set for each time period, the specified number of times of the nip-position change control changes even in a day. That is, in the configuration in which the pressure release control is performed when the stop period (i.e., print stop period) of image formation is continued even after the predetermined number of times of the nip-position change control is performed after the completion of sheet passing, the pressurization state of the fixing unit is kept as much as possible, in a time period in which the average stop period is short, by increasing the predetermined number of times. In contrast, in a time period in which the average stop period is long, the pressure in the fixing unit is released earlier by decreasing the predetermined number of times. With this operation, the merit of shortening the SFPOT and suppressing the operation sound and the power consumption can be achieved.

Furthermore, in the second embodiment, the type of the fixing-set mark prevention control is changed in accordance with a sheet passing history. That is, in the configuration in which the pressure release control is performed when the stop period of image formation is continued even after the predetermined number of times of the nip-position change control is performed after the completion of sheet passing, the predetermined number of times for each time period is changed in accordance with a history of operations of the image forming apparatus. With this operation, a control type optimized for a use environment of the image forming apparatus can be selected, and the merit of shortening the SFPOT and suppressing the operation sound and the power consumption can be achieved. Note that the method of estimating the operating conditions is not limited to the specific examples described in the present embodiment, and time period and the number of samples for averaging can be optimized for an environment where the image forming apparatus is installed.

Modification

In the second embodiment, the description has been made, as an example, for the configuration that optimizes the specified number of times of the nip-position change control, determined for each time period, in accordance with a history of operations of the image forming apparatus. Instead of this, the specified number of times of the nip-position change control determined for each time period may be prestored in a storage medium such as a ROM, and the specified number of times may be read by the CPU when the CPU executes the fixing-set mark prevention control. In this case, a plurality of data sets on the specified number of times of the nip-position change control determined for each time may be prepared, and one of the data sets may be selectively used in accordance with a user's explicit operation, a day of the week, a season or the like.

Third Embodiment

In a third embodiment, in a state where the pressure release control has been performed by the fixing-set mark prevention control described in the first or the second embodiment, the SFPOT is shortened by a method that predicts a timing at which a user uses the image forming apparatus and that performs a pressurization operation in advance. The same description as that for the first or the second embodiment will be omitted, and the description will be made, with a component having substantially the same structure and operation as a component of the above-described embodiments being given the same reference symbol.

Description of Functional Block of Third Embodiment

Figure 10:
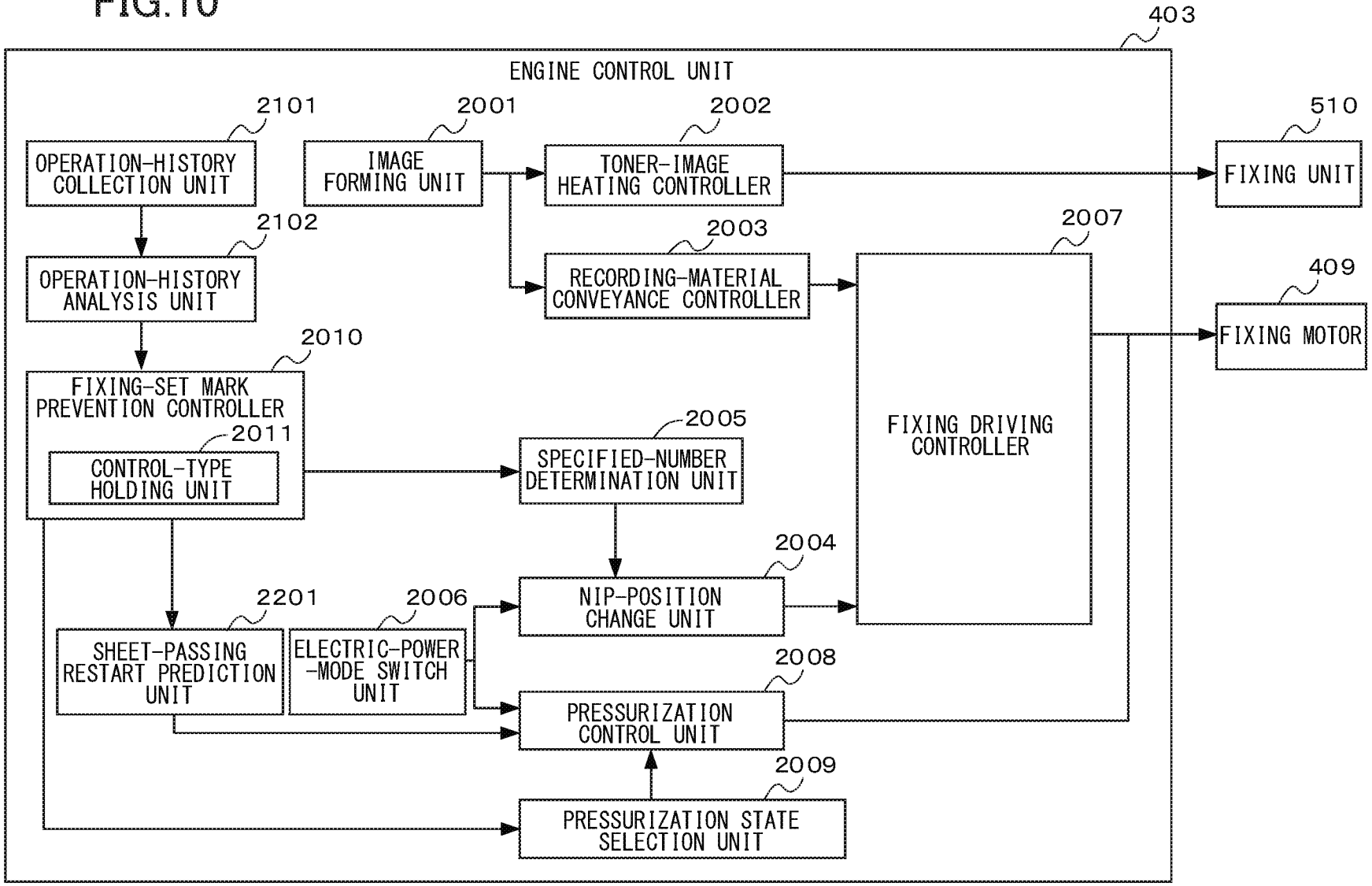
FIG. 10 is a functional block diagram in a third embodiment.

As illustrated in a functional block diagram of FIG. 10, an engine control unit 403 of the present embodiment includes a sheet passing restart prediction unit 2201 that has functions on a history of operations of the image forming apparatus. The sheet passing restart prediction unit 2201 predicts a timing at which the next sheet passing is requested, in accordance with an analysis result by the operation-history analysis unit 2102. At the predicted timing, the sheet passing restart prediction unit 2201 sends an instruction to transition the fixing unit from the second pressurization state (pressure release state) to the first pressurization state (normal pressurization state), to the pressurization control unit 2008.

Method of Determining Pressurization Timing in Third Embodiment

The average stop time S_ave in a time period of a day of the week can be estimated by using the method described in the second embodiment. The stop time means not only the length of a stop time of the image forming apparatus expected for the time period, but also a timing at which the image forming apparatus returns from the sleep state again. That is, the SFPOT can be improved by performing the pressurization operation of the fixing unit when a predetermined condition is satisfied before the expected return time.

Figure 11:
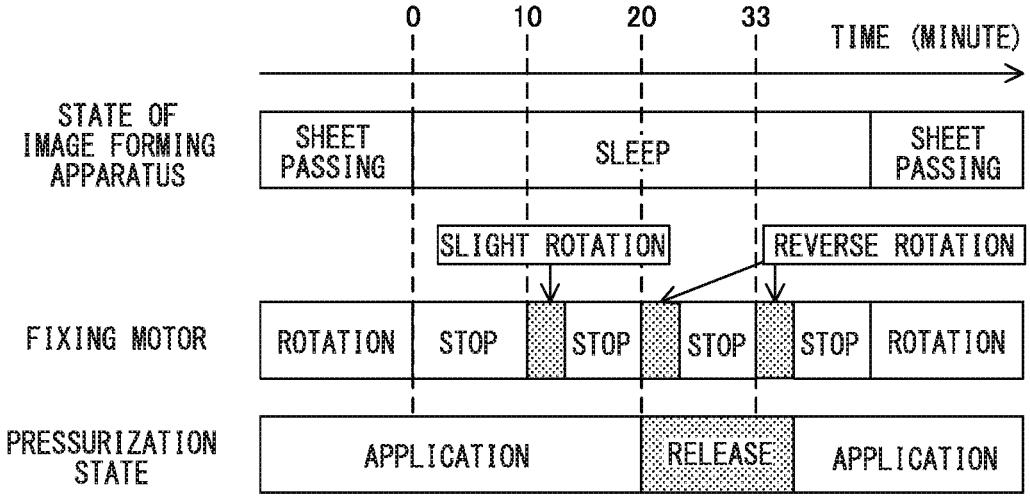
FIG. 11 illustrates a sequence of operations for illustrating a pressurization timing of the third embodiment.

A specific operation will be described with reference to FIG. 11. Note that the description will be made for a case where the fixing-set mark prevention control is performed when the image forming apparatus transitions to the sleep state, by using the method of the first embodiment, and where the time period is, as one example, 12:00 in Table 2. Since the fixing-set mark prevention control for this time period is type B, the pressure release control is executed when 20 minutes has elapsed from the transition to the sleep state. On the other hand, in Table 3, an average return-from-sleep timing in the time period of 12:00 is a timing at which 34 minutes has elapsed. Thus, after the image forming apparatus transitions to the sleep state, the pressurization operation of the fixing unit is performed at an expected return timing at which 33 minutes has elapsed and which is one minute earlier than the average return-from-sleep timing. Specifically, the fixing film 123 and the pressure roller 124 are transitioned to the first pressurization state, in which the fixing film 123 and the pressure roller 124 are pressed by a pressing force suitable for image formation and form the fixing nip, by rotating the fixing motor in a reverse direction.

In addition, the description will also be made for a case where the time period is, as another example, 8:00 in Table 2. Since the fixing-set mark prevention control for this time period is type B, the pressure release control is executed when 20 minutes has elapsed from the transition to the sleep state. On the other hand, in Table 3, an average return-from-sleep timing in the time period of 8:00 is a timing at which 51 minutes has elapsed. Thus, after the image forming apparatus transitions to the sleep state, the pressurization operation is performed at an expected return timing at which 50 minutes has elapsed (the expected return time is 50 minutes) and which is one minute earlier than the average return-from-sleep timing.

Figure 12:
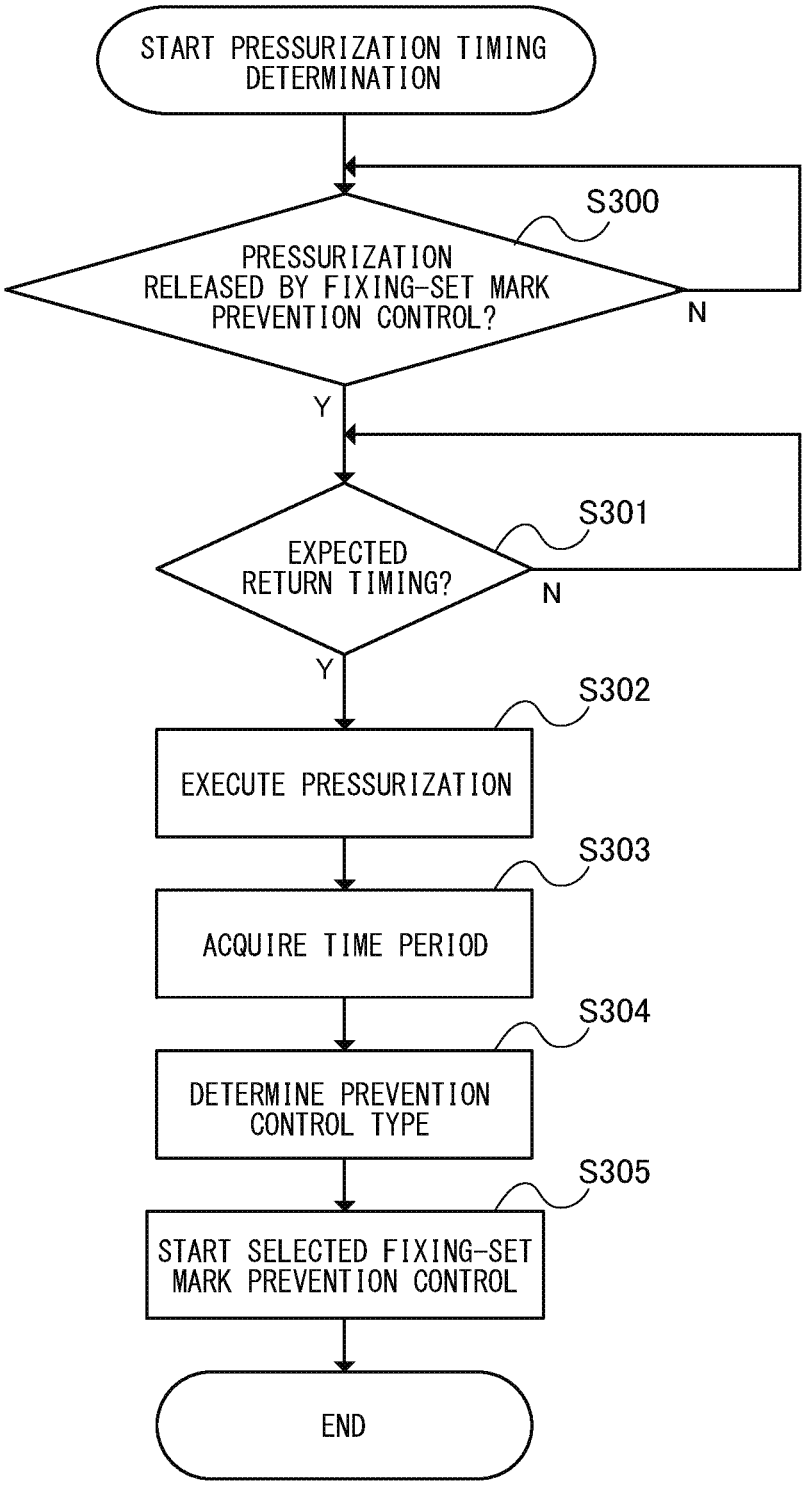
FIG. 12 is a flowchart illustrating a pressurization-timing determination process of the third embodiment.

With reference to FIG. 12, a specific control flow will be described. As described above, the pressurization operation is performed by the pressurization control unit 2008 when the pressure release control is completed by the fixing-set mark prevention control, and when a return timing in the time period expected by the sheet passing restart prediction unit 2201 is reached (S300, S301, S302). In a case where the image forming apparatus returns from the sleep state to the normal state as expected, when the image forming apparatus transitions to the sleep state again, the fixing-set mark prevention control can be performed in accordance with the flow of FIG. 6. However, it is necessary to consider another case in which a new sheet passing request is not made as expected and the sleep state is continued. In such a case, a new time period is obtained (S303), a type of the prevention control is determined (S304), and the fixing-set mark prevention control is simultaneously started (S305). With these operations, even if the image forming apparatus does not return from the sleep state as expected, the occurrence of the fixing-set mark caused by the deformation of the pressure roller, caused by the pressurization, can be prevented.

As described above, in the third embodiment, the SFPOT can be improved by expecting a timing at which a user uses the image forming apparatus, and by performing the pressurization operation of the fixing unit before a sheet passing request. Note that the pressurization timing may be determined not from an average stop time determined by the method described in the second embodiment as an example, but from an average stop time predetermined for each time period (see Table 3).

Fourth Embodiment

A fourth embodiment uses a method in which the control to perform the nip-position change control and the control to perform the pressure release control after the specified number of times of execution of the nip-position change control is performed are combined. The nip-position change control is performed at interval times that correspond to a degree of use of the fixing unit (i.e., length of an accumulated operating time). Compared to the above-described first to third embodiments, the fourth embodiment can reduce the frequency of the nip-position change control and suppress the occurrence of the operation sound while preventing the fixing-set mark, by optimizing the length of the interval time. Hereinafter, the same description as that for the first to the third embodiments will be omitted, and the description will be made, with a component having substantially the same structure and operation as a component of the above-described embodiments being given the same reference symbol.

Figure 13:
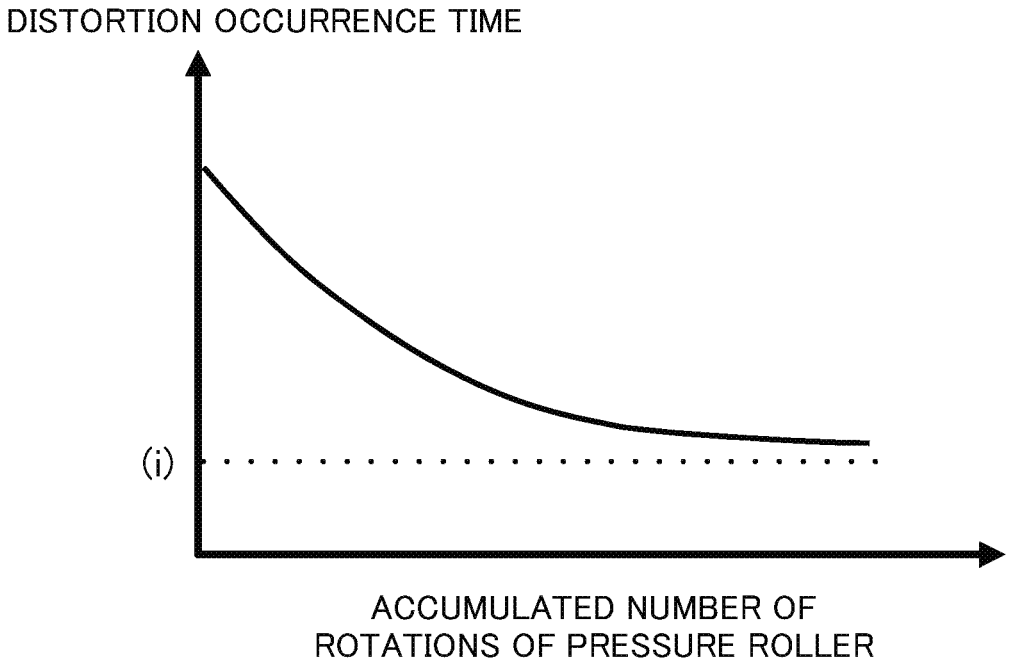
FIG. 13 is a graph illustrating a relationship between the degree of use of a pressure roller and the distortion occurrence time.

As described above, when the pressurization state of the fixing unit is kept in a stop period of the image forming apparatus, and one portion of the pressure roller 124 is constantly located in the fixing nip portion N for a long time, the deformation caused by the pressurization in the fixing nip portion N is left on the pressure roller 124, as history, and causes distortion of the pressure roller 124. FIG. 13 illustrates the time taken for the distortion to occur in a pressurization state, plotted with respect to the accumulated number of rotations of the pressure roller 124. The accumulated number of rotations can be regarded as a parameter that indicates the degree of use (length of the accumulated operating time) of the pressure roller 124.

As illustrated in FIG. 13, as the accumulated number of rotations of the pressure roller 124 increases, and the degree of use of the pressure roller 124 progresses, the rubber layer of the pressure roller 124 deteriorates, and the distortion of the pressure roller 124 more easily occurs in the fixing nip portion N, due to the deformation caused by the pressurization. Thus, when the fixing-set mark is prevented by the nip-position change control, it has been common that the length of the interval time is set at a sufficiently short value as illustrated by a symbol (i) of FIG. 13 so that the fixing-set mark does not occur even when the pressure roller 124 gradually deteriorates.

In the present embodiment, for preventing the fixing-set mark by using the minimum number of times of the nip-position change control determined in accordance with the degree of use of the fixing unit, the control to perform the nip-position change control with an optimum interval time that is set in accordance with the accumulated number of rotations of the pressure roller 124 is added. That is, when the accumulated number of rotations of the pressure roller 124 is small, a time longer than the time indicated by the symbol (i) of FIG. 13 is set to the interval time.

In the first to the third embodiments, a time from the completion of sheet passing to the execution of the pressure release control is determined by multiplication of the specified number of times and the interval time. In the present embodiment, however, when the accumulated number of rotations of the pressure roller 124 is small, the interval time is long. Thus, if the present embodiment uses the computational equation, the time from the completion of sheet passing to the execution of the pressure release control will extend significantly. By the way, it is more suitable that whether to keep the pressurization state for the next sheet passing request is determined depending on an elapsed time from the completion of the last sheet passing, because the determination is not directly related to the degree of use of the fixing unit.

Thus, in the present embodiment, the specified number of times of execution of the nip-position change control is changed in accordance with the accumulated number of rotations of the pressure roller 124, such that the pressure release control is performed when the elapsed time from the completion of the last sheet passing is in a range from 60 to 75 minutes. In other words, regardless of the accumulated number of rotations of the pressure roller 124, the pressure release control is performed, started in a time period in which a certain time (in the present embodiment, 60 to 75 minutes) has elapsed from the completion of the last sheet passing, by changing the specified number of times of execution of the nip-position change control. With this operation, when the interval time is long, the number of times of execution of the nip-position change control is reduced, and the operation sound and the power consumption can be further suppressed.

Functional Block in Fourth Embodiment

Figure 14:
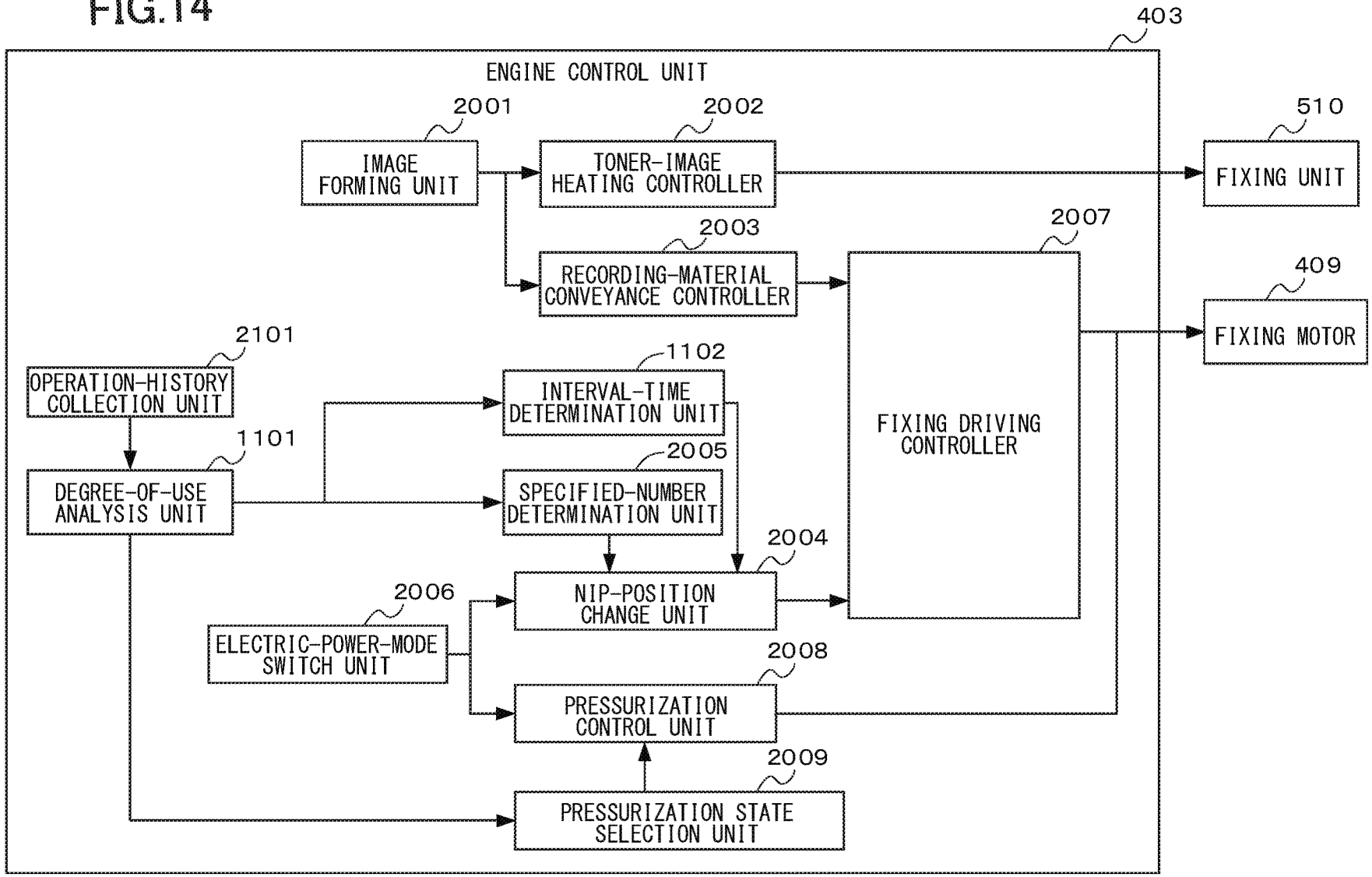
FIG. 14 is a functional block diagram in a fourth embodiment.

As illustrated in a functional block diagram of FIG. 14, an engine control unit 403 of the present embodiment includes a degree-of-use analysis unit 1101 that has functions to analyze a history of operations of the image forming apparatus. The engine control unit 403 also includes an interval-time determination unit 1102 that has functions related to the nip-position change unit 2004.

The degree-of-use analysis unit 1101 uses a counter (pressure-roller rotation counter) that measures the number of rotations of the pressure roller 124 collected by the operation-history collection unit 2101, and analyzes the degree of use of the fixing unit 510. The specified-number determination unit 2005 and the interval-time determination unit 1102 respectively determine the specified number of times of the nip-position change control and the interval time in accordance with the degree of use of the fixing unit 510 analyzed by the degree-of-use analysis unit 1101. The nip-position change unit 2004 causes the fixing driving controller 2007 to control the fixing motor 409, in accordance with the determined specified number of times, interval time, and an interval timer. The nip-position change unit 2004 includes a nip-position change counter, and increments the nip-position change counter by one every time the nip-position change unit 2004 changes the fixing nip position.

Description of Fixing-Set Mark Prevention Control in Fourth Embodiment

Figure 15:
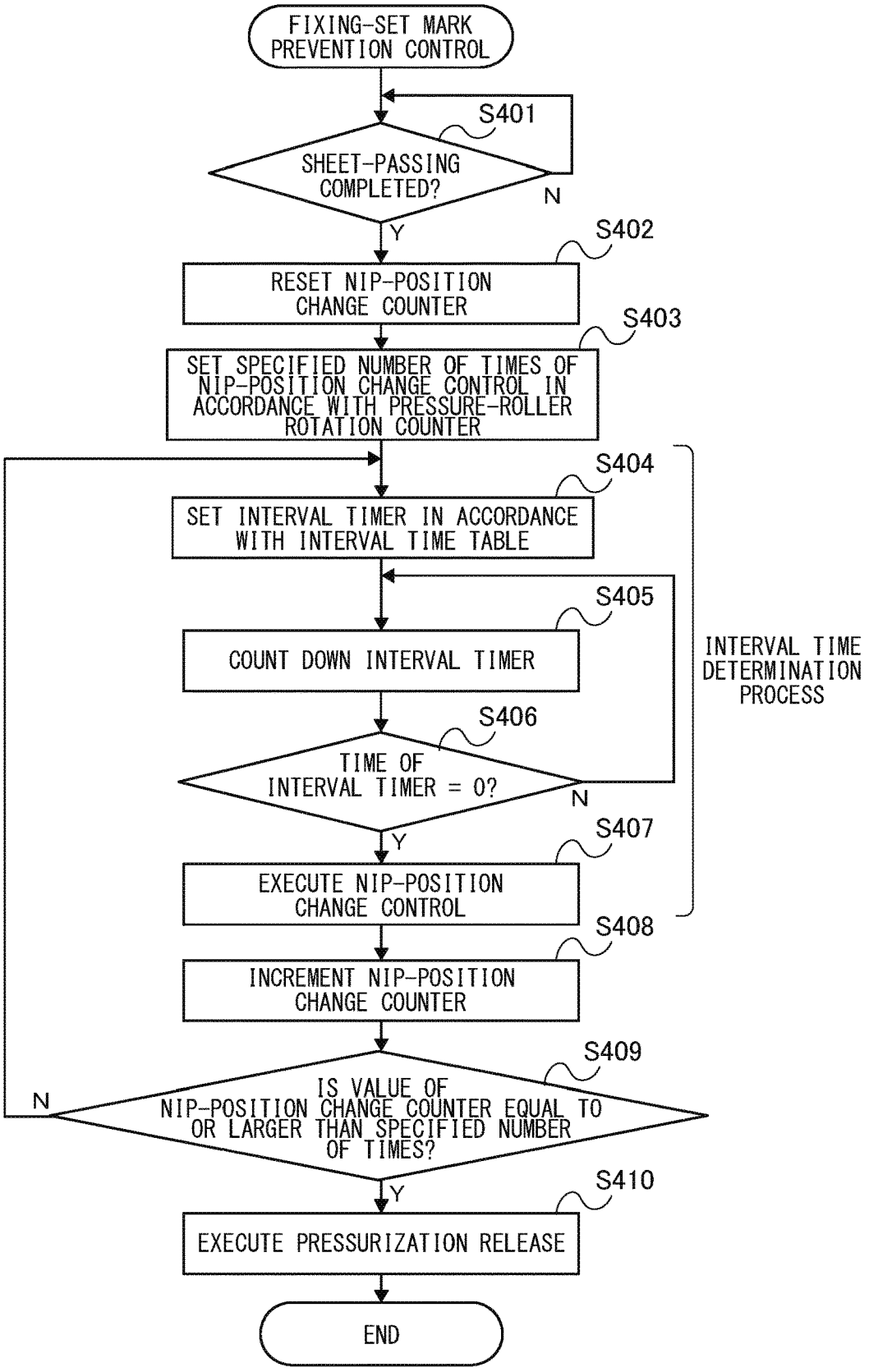
FIG. 15 is a control algorithm for fixing-set mark prevention control of the fourth embodiment.

FIG. 15 is a flowchart illustrating an algorithm of the fixing-set mark prevention control of the present embodiment. The flow starts when a sheet passing completes (S401). First, the nip-position change unit 2004 resets the nip-position change counter (S402). The specified-number determination unit 2005 sets the specified number of times of the nip-position change control in accordance with a value of the pressure-roller rotation counter (S403). The interval-time determination unit 1102 uses an interval time table shown as Table 4, and determines an interval time in accordance with a value of the pressure-roller rotation counter, and sets the interval time to the interval timer (S404). Then the interval-time determination unit 1102 causes the interval timer to count down (S405). When the value of the interval timer becomes zero, the nip-position change control is performed (S406, S407).

TABLE 4

| PRESSURE-ROLLER ROTATION COUNTER VALUE | SET TIME OF INTERVAL TIMER |
|---|---|
| 0~72000 | 35 MINUTES |
| 72001~144000 | 25 MINUTES |
| 144001~216000 | 15 MINUTES |
| 216001~ | 10 MINUTES |

Figure 16:
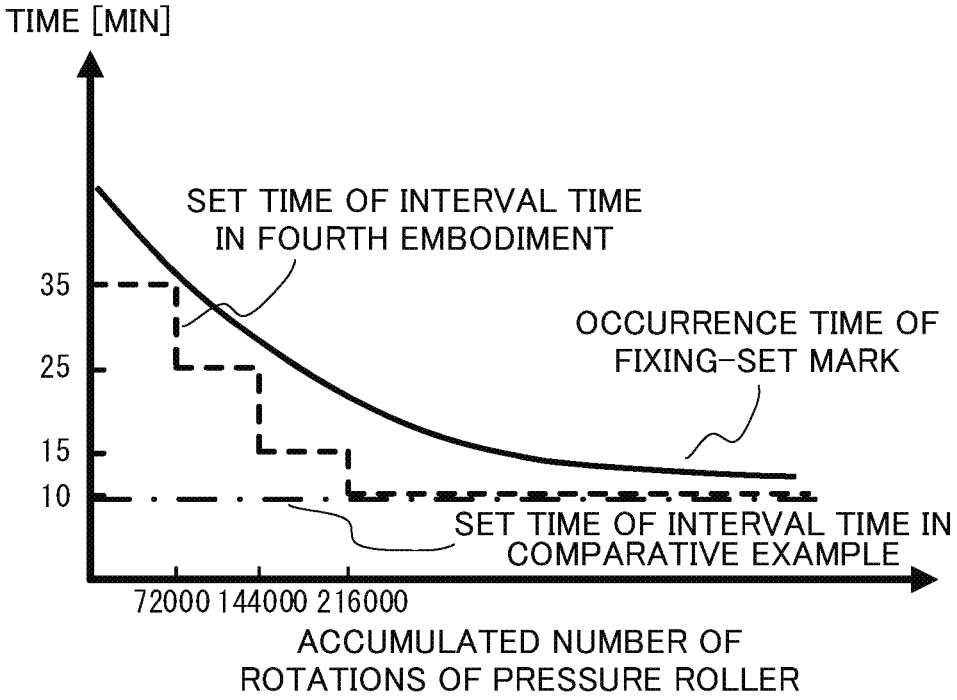
FIG. 16 is a diagram for illustrating a set value for an interval time of the fourth embodiment.

As shown in Table 4, the smaller the value of the pressure-roller rotation counter, the longer the set value of the interval time. That is, as illustrated in FIG. 16, the smaller the accumulated number of rotations of the pressure roller (i.e., the smaller the degree of use of the fixing unit), the longer the interval time of the nip-position change control. Thus, the interval-time determination unit 1102 performs the operations (S404 to S407) for determining the interval time as described above.

After the execution of the nip-position change control, the value of the nip-position change counter is incremented by one (S408). Then, the specified number of times of the nip-position change control in accordance with the value of the pressure-roller rotation counter is obtained by referring to Table 5.

TABLE 5

| PRESSURE-ROLLER ROTATION COUNTER VALUE | SPECIFIED NUMBER OF TIMES OF NIP-POSITION CHANGE CONTROL |
|---|---|
| 0~72000 | 2 |
| 72001~144000 | 3 |
| 144001~216000 | 4 |
| 216001~ | 6 |

If the value of the nip-position change counter is equal to or larger than the specified number of times obtained, the pressure release control is performed (S409, S410). If the value of the nip-position change counter is smaller than the specified number of times for the pressure release that has been referred to, the step (S404) to set the interval timer is executed again and the following process is performed.

The specified number of times of the nip-position change control shown in Table 5 is set in accordance with the value of the pressure-roller rotation counter, such that the product of the interval time, determined in accordance with the counter value, and the specified number of times is equal to or larger than 60 and equal to or smaller than 75. With the set value, when the stop period in which no sheet is passed continues 60 minutes or more, the pressure release control is performed before the stop period extends up to 75 minutes. Note that in the present embodiment, the pressure release control is performed after the nip-position change control has been performed the specified number of times.

As described above, when a sheet passing completes, the interval time is determined by the interval-time determination unit, and the nip-position change control is performed with the interval time. If the stop period of sheet passing, from the completion of sheet passing becomes larger than a predetermined length, the pressurization to the fixing film 123 and the pressure roller 124 is released by performing the pressure release control. The fixing-set mark prevention control of the present embodiment is performed in the above-described manner.

Merit of Fixing-Set Mark Prevention Control of Fourth Embodiment

Merits of the fixing-set mark prevention control of the present embodiment will be described, compared to a comparative example. The comparative example differs from the present embodiment in that the set value of the interval time of the nip-position change control is constantly 10 minutes regardless of the accumulated number of rotations of the pressure roller 124, and that the pressure release control is not performed even when the stop period of sheet passing becomes long. The other features of the comparative example are the same as those of the present embodiment. Specifically, as illustrated in FIG. 16, although the present embodiment (broken line) changes the set value of the interval time in accordance with the accumulated number of rotations of the pressure roller 124, the comparative example (alternate long and short dashed line) has a constant set value of the interval time.

Compared to the comparative example, the present embodiment has a set value of the interval time longer than 10 minutes when the accumulated number of rotations of the pressure roller 124 is equal to or smaller than 216,000. Thus, in such a state, the present embodiment can reduce the frequency of execution of the nip-position change control compared to the comparative example, while avoiding the risk of occurrence of the fixing-set mark.

Figure 17A:
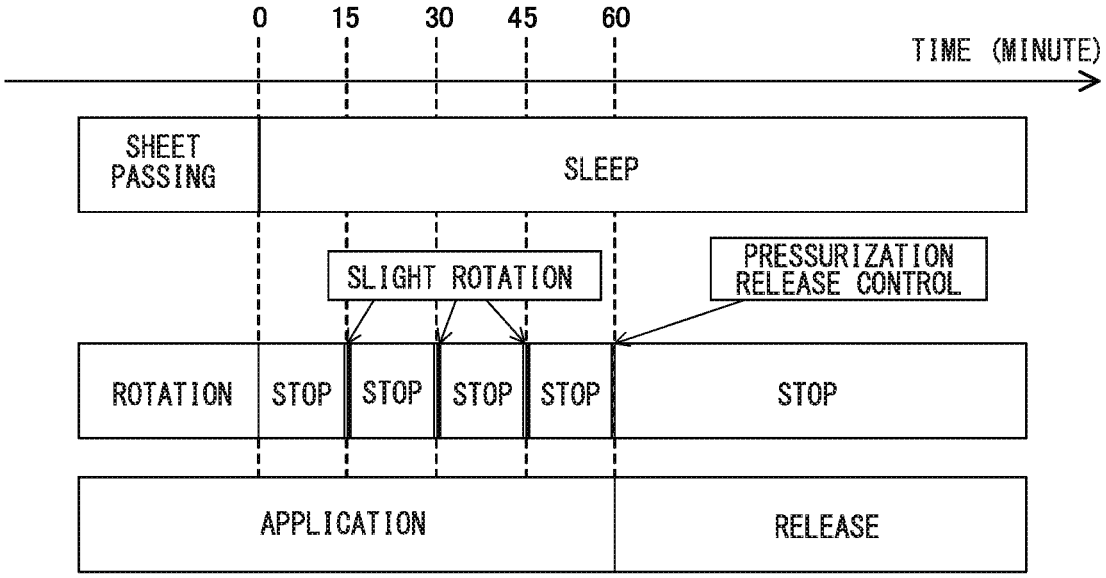
FIG. 17A illustrates a sequence of operations of the fixing-set mark control of the fourth embodiment.
Figure 17B:
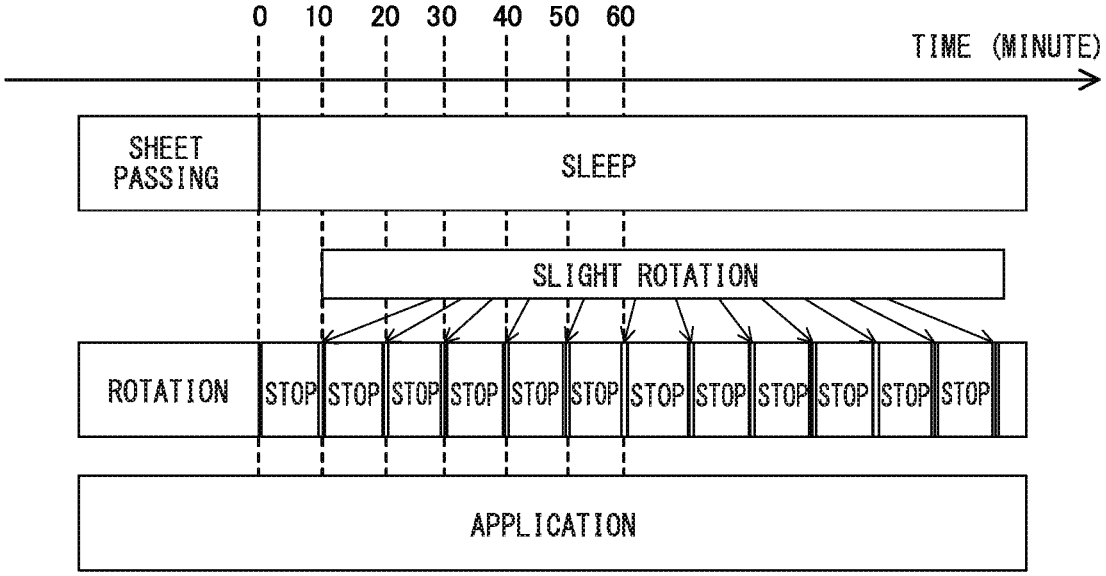
FIG. 17B illustrates a sequence of operations of the fixing-set mark control of a comparative example.

FIG. 17A illustrates an example of a sequence of operations of the nip-position change control of the image forming apparatus in the present embodiment. FIG. 17B illustrates an example of a sequence of operations of the nip-position change control of the image forming apparatus in the comparative example In the examples illustrated in FIGS. 17A and 17B, the accumulated number of rotations of the pressure roller 124 is in a range from 144,001 to 216,000. As illustrated in FIGS. 17A and 17B, the number of times of execution of the nip-position change control obtained when 60 minutes has elapsed from the completion of sheet passing is four in the present embodiment, and six in the comparative example. Thus, it is understood that the present embodiment reduces the frequency of execution of the nip-position change control and suppresses the frequency of occurrence of the operation sound and the power consumption in the sleep state. In addition, it is also understood in FIGS. 17A and 17B that since the present embodiment performs the pressure release control after 60 minutes has elapsed from the completion of sheet passing, the present embodiment can suppress the operation sound and the power consumption, compared to the comparative example in which the nip-position change control is repeated even after the 60 minutes has elapsed.

As described above, since the nip-position change control is performed with the interval time that is changed in accordance with the degree of use of the fixing unit, the present embodiment can further suppress the frequency of the occurrence of operation sound and the power consumption in the sleep state, compared to the above-described first to the third embodiments.

Note that although the accumulated number of rotations of the pressure roller 124 is used, in the present embodiment, as a variable indicating the degree of use of the pressure roller 124, the interval time may be changed in accordance with another variable that is related to the degree of use of a rotary member that causes the fixing-set mark. Examples of the other variable may include the accumulated number of product sheets (prints) outputted by the image forming apparatus, and an accumulated time of rotation of the pressure roller 124. In addition, it is preferable that the interval time be changed in accordance with the accumulated number of rotations of the fixing film 123 or the accumulated time of rotation of the fixing film 123, as the degree of use of the pressure roller 124. Note that if a fixing roller having an elastic layer is used instead of the fixing film 123, the deformation of the fixing roller may cause the fixing-set mark. In this case, the interval time is preferably changed in accordance with the accumulated number of rotations of the fixing roller or the accumulated time of rotation of the fixing roller.

Fifth Embodiment

In a fifth embodiment, in addition to the configuration and control of the fourth embodiment, the nip-position change control is performed with an optimum interval time in accordance with a degree of heat storage of the pressure roller 124, for further suppressing the frequency of occurrence of the operation sound and the power consumption. Hereinafter, the same description as that for the first to the fourth embodiments will be omitted, and the description will be made, with a component having substantially the same structure and operation as a component of the above-described embodiments being given the same reference symbol.

Figure 18:
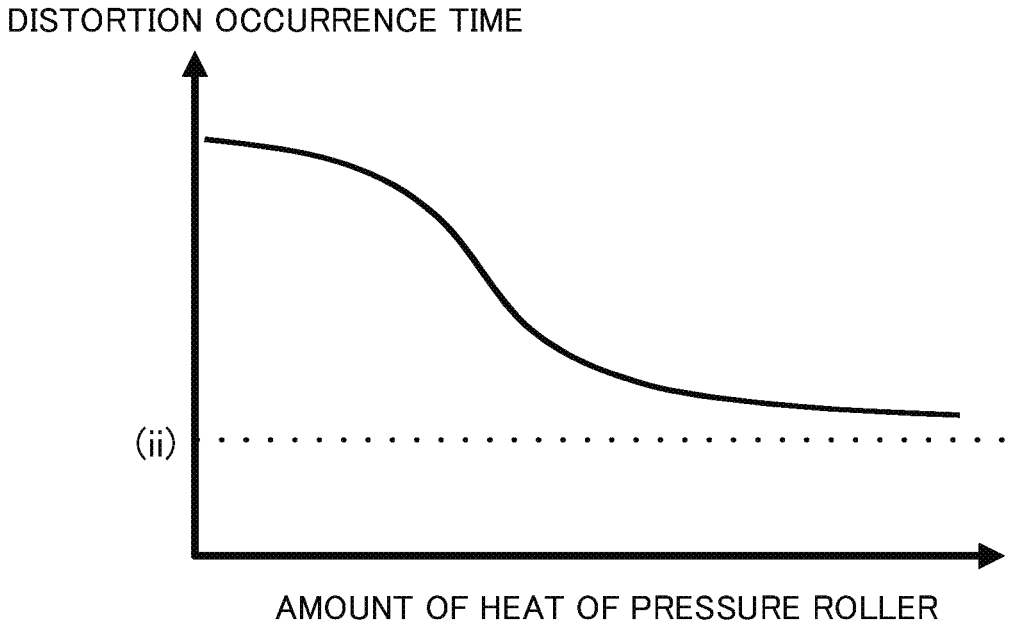
FIG. 18 is a graph illustrating a relationship between the degree of heat storage of a pressure roller and the distortion occurrence time.

FIG. 18 illustrates the time taken for the distortion to occur in the pressurization state, plotted with respect to the amount of heat stored in the pressure roller 124. As illustrated in FIG. 18, as the amount of heat stored in the pressure roller 124 increases, the fixing-set mark occurs more easily, and occurs when the pressure roller 124 has been left for a short time. Thus, when the fixing-set mark is prevented by the nip-position change control, it is supposed to be ordinary that the length of the interval time is set at a sufficiently short value as illustrated by a symbol (ii) of FIG. 18 so that the fixing-set mark does not occur even when the degree of heat storage of the pressure roller 124 is high.

In the present embodiment, for preventing the fixing-set mark by using the minimum number of times of the nip-position change control determined in accordance with the degree of heat storage of the pressure roller 124, the control to perform the nip-position change control in accordance with an optimum interval time that is set in accordance with the degree of heat storage of the pressure roller 124 is added. That is, when the amount of heat storage of the pressure roller 124 is small, a time longer than the time indicated by the symbol (ii) of FIG. 18 is set to the interval time.

Functional Block in Fifth Embodiment

Figure 19:
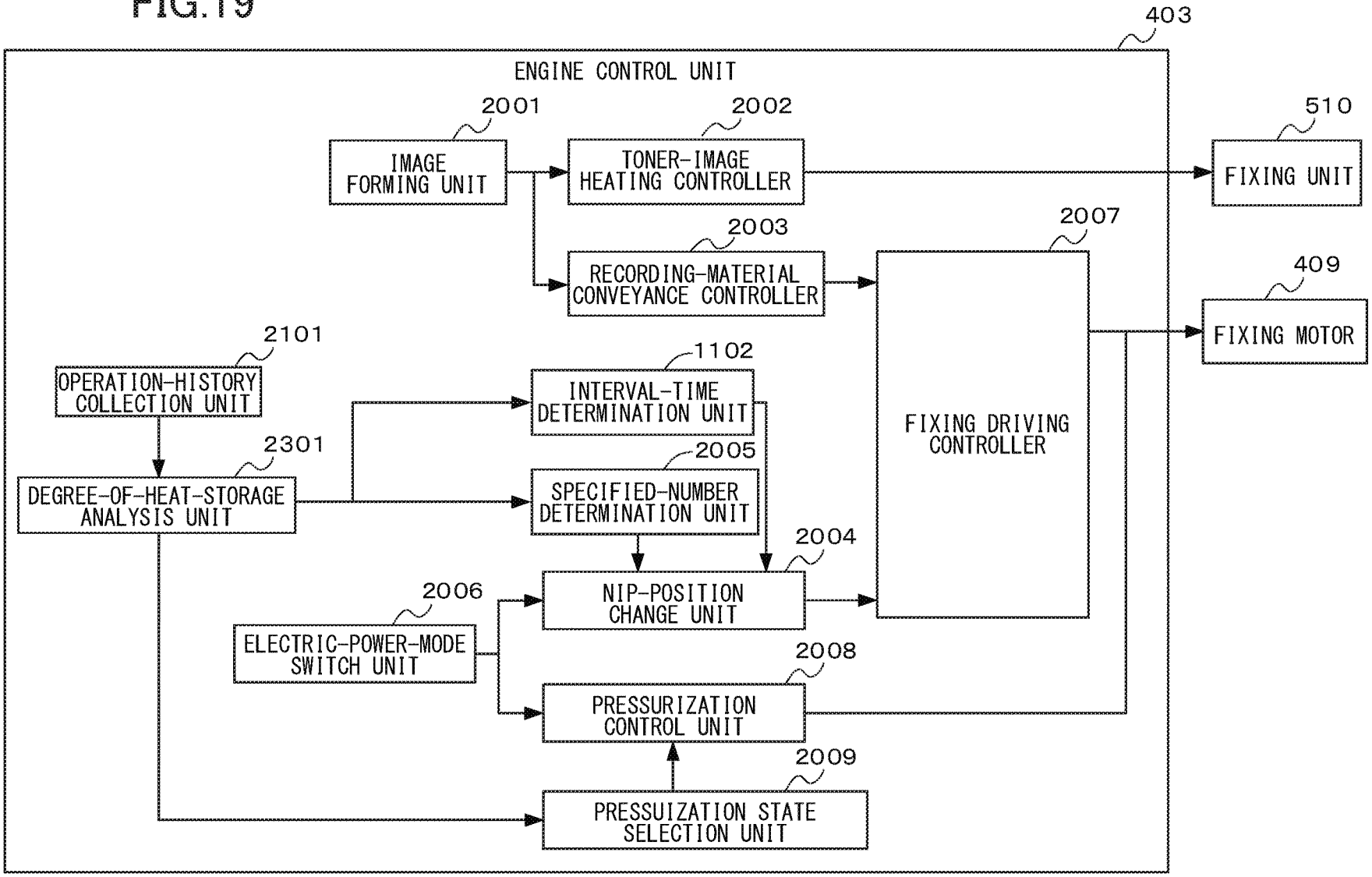
FIG. 19 is a functional block diagram in a fifth embodiment.

As illustrated in a functional block diagram of FIG. 19, an engine control unit 403 of the present embodiment includes a degree-of-heat-storage analysis unit 2301 that has functions to analyze a history of operations of the image forming apparatus. The degree-of-heat-storage analysis unit 2301 analyzes the degree of heat storage of the fixing unit 510, depending on data collected by the operation-history collection unit 2101. The specified-number determination unit 2005 and the interval-time determination unit 1102 respectively determine the specified number of times of the nip-position change control and the interval time in accordance with the degree of heat storage of the fixing unit 510 analyzed by the degree-of-heat-storage analysis unit 2301.

Fixing-Set Mark Prevention Control of Fifth Embodiment

The amount of heat storage of the pressure roller 124 can be estimated from a history of operations of the image forming apparatus, specifically, from a target temperature (adjusted temperature) of the fixing film 123 in the sheet passing, a sheet passing mode that indicates a type (sheet type) of the recording material that is passed, and the number of sheets of the recording material that have been passed. In the present embodiment, since the adjusted temperature is set for each sheet passing mode, the amount of heat storage of the pressure roller 124 can be estimated from the sheet passing mode and the number of sheets having been passed. In the present embodiment, for simply determining the amount of heat storage of the pressure roller 124 obtained when a sheet passing completes, the information included in the history of operations and related to the sheet passing mode and the number of sheets having been passed is converted to a warm-up index that is an estimated value of the amount of heat storage of the pressure roller 124.

Table 6 is a table (hereinafter referred to as a warm-up-index additional-value table) of a warm-up-index additional value per one sheet. The warm-up-index additional value is determined depending on a sheet passing timing with respect to the completion of sheet passing, and on the sheet passing mode. As shown in Table 6, the warm-up-index additional value per one sheet is determined depending on an elapsed time from a sheet passing and a sheet passing mode. The warm-up-index additional value is determined for each section (A period to C period) of sheet passing timing and each sheet passing mode, and relatively expresses the amount of heat stored in the pressure roller 124 when one sheet of the recording material is passed.

In the present embodiment, the sheet passing timing is grouped into three sections: A period from 10 minutes before the completion of sheet passing to the completion of sheet passing, B period from 20 minutes before the completion of sheet passing to 10 minutes before the completion of sheet passing, and C period from 30 minutes before the completion of sheet passing to 20 minutes before the completion of sheet passing. The heat stored in the pressure roller 124 through sheet passing is gradually dissipated with time. Thus, in an identical sheet passing mode, the warm-up index in C period is smaller than the warm-up index in A period, and the warm-up index in B period has a value between the warm-up index in A period and the warm-up index in C period. The degree-of-heat-storage analysis unit 2301 uses Table 6 and calculates the product of a warm-up-index additional value per one sheet and the number of sheets having been passed, and totalizes the products in all the sheet passing modes and holds the resultant value as a current warm-up index.

TABLE 6

| | ADDITIONAL VALUE OF WARM-UP INDEX PER SHEET SHEET-PASSING TIMING | | |
|---|---|---|---|
| | 0 TO 10 MINUTES BEFORE COMPLETION OF IMAGE FORMATION | 10 TO 20 MINUTES BEFORE COMPLETION OF IMAGE FORMATION | 20 TO 30 MINUTES BEFORE COMPLETION OF IMAGE FORMATION |
| | SHEET-PASSING MODE | | |
| | (A PERIOD) | (B PERIOD) | (C PERIOD) |
| PLAIN-PAPER MODE | 20 | 10 | 0 |
| THIN-PAPER MODE | 20 | 10 | 0 |
| THICK-PAPER MODE | 40 | 30 | 20 |
| GLOSS-PAPER MODE | 40 | 30 | 20 |

Figure 20:
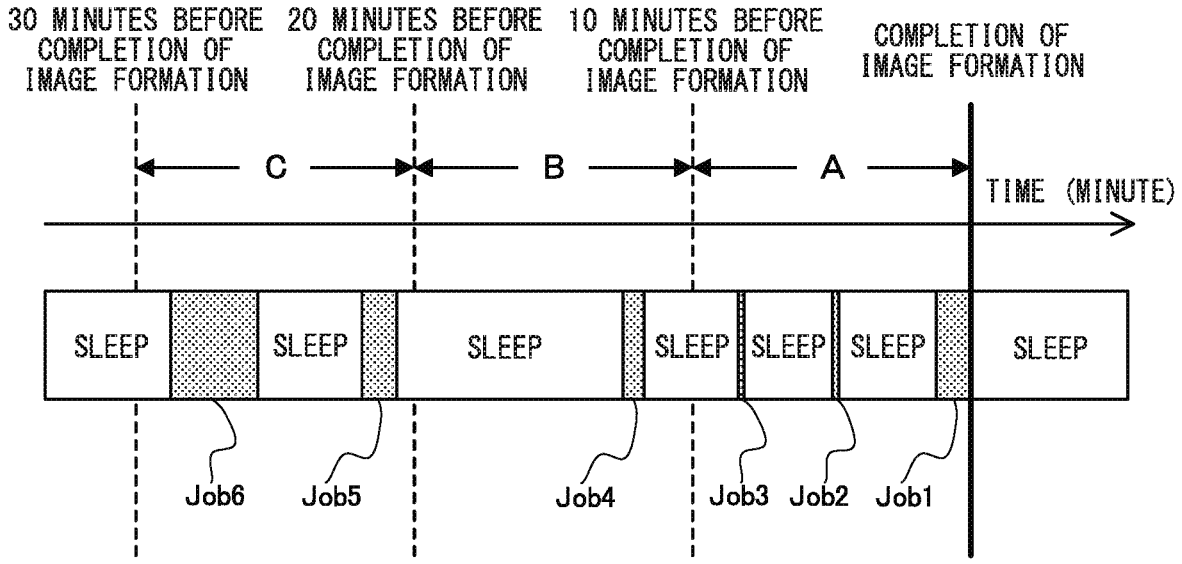
FIG. 20 is a schematic diagram illustrating an example of a history of operations of an image forming apparatus of the fifth embodiment.

Next, a method of calculating a warm-up index will be described by using a specific example of a history of operations obtained at a certain point of time immediately after a sheet passing. A history of operations illustrated in FIG. 20 is a history of operations obtained when a sheet passing job, Job 1, completes. In this example, Job 1, Job 2, and Job 3 were executed in A period, Job 4 was executed in B period that precedes A period, and Job 5 and Job 6 were executed in C period that precedes B period. The sheet passing mode and the number of sheets having been passed in each job are as follows.

Job 1: gloss paper mode, 20 sheets
Job 2: plain-paper mode, 5 sheets
Job 3: thick-paper mode, 1 sheet
Job 4: plain-paper mode, 30 sheets
Job 5: thick-paper mode, 2 sheets
Job 6: plain-paper mode, 100 sheets In this case, warm-up-index additional values for A period, B period, and C period are respectively calculated as 940, 300, and 40 by using the following equations.

$$\text{Additional value for } A\text{period}=(40\times20)+(20\times5)+(40\times1) \quad \text{Equation 3}$$

In Equation 3, the value 40 (in the first parenthesis) is a warm-up-index additional value for A period in the gloss paper mode, the value 20 (in the second parenthesis) is a warm-up-index additional value for A period in the plain-paper mode, and the value 40 (in the third parenthesis) is a warm-up-index additional value for A period in the thick-paper mode.

$$\text{Additional value for } B \text{ period}=10\times30 \quad \text{Equation 4}$$

In Equation 4, the value 10 is a warm-up-index additional value for B period in the plain-paper mode.

$$\text{Additional value for } C \text{ period}=(20\times2)+(0\times100) \quad \text{Equation 5}$$

In Equation 5, the value 20 is a warm-up-index additional value for C period in the thick-paper mode, and the value 0 is a warm-up-index additional value for C period in the plain-paper mode.

Thus, the warm-up index at the completion of Job 1 is calculated as 1280 by using following Equation 6.

$$\text{Warm-up index at the completion of Job1}=\text{additional value for } A\text{period}+\text{additional value for } B\text{period}+\text{additional value for } C\text{period} \quad \text{Equation 6}$$

The additional time for the interval time in the sleep period after Job 1 is determined from an interval-time addition table of Table 7, in accordance with the warm-up index.

TABLE 7

| WARM-UP INDEX | ADDITIONAL VALUE OF INTERVAL TIME |
|---|---|
| 1001~2000 | +0 MINUTES |
| 401~1000 | +5 MINUTES |
| 0~400 | +10 MINUTES |

As shown in Table 7, the smaller the warm-up index, the longer the interval time is extended. That is, the smaller the amount of heat of the fixing film 123 and the pressure roller 124, the longer the interval time is extended.

Figure 21:
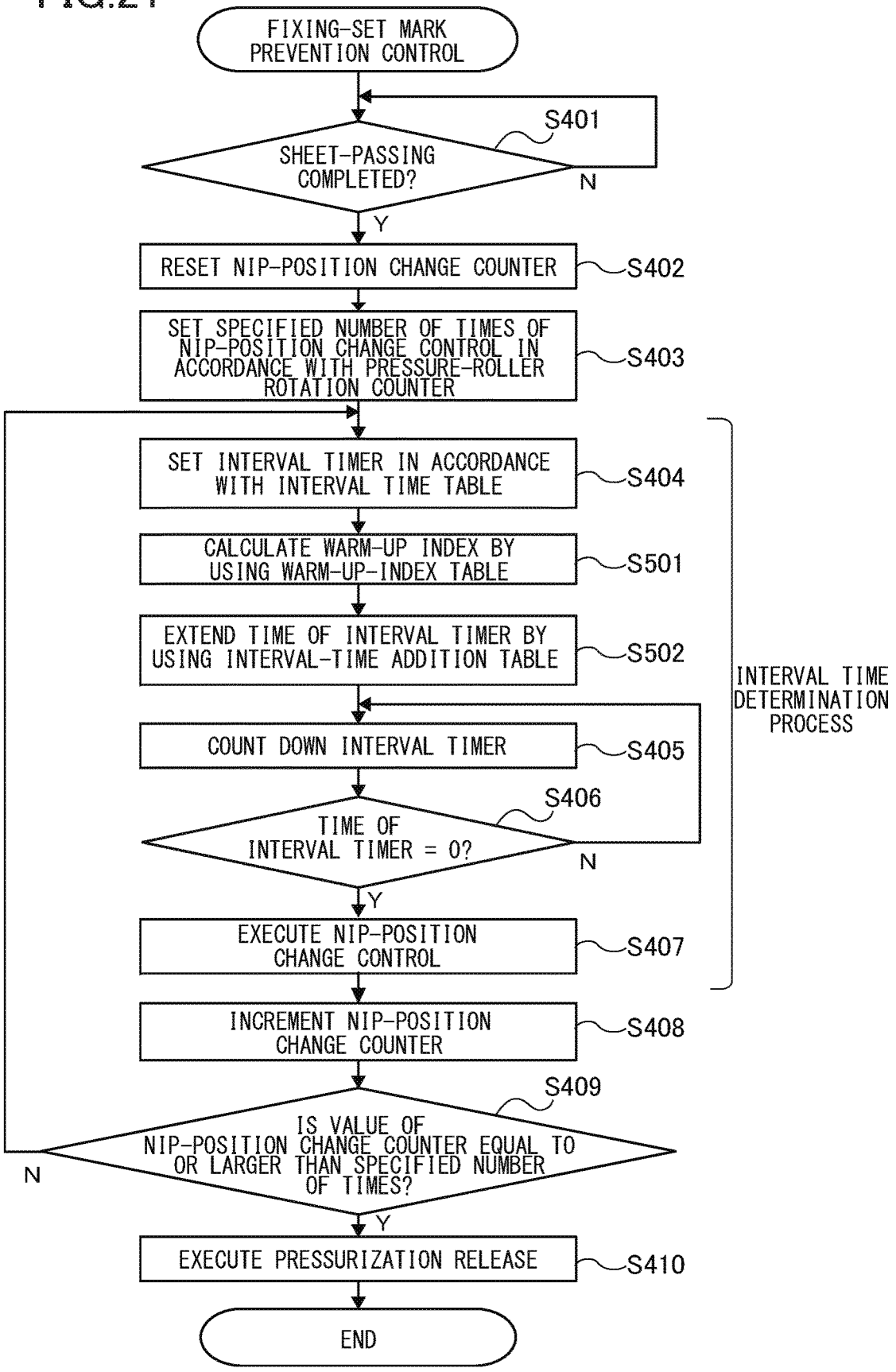
FIG. 21 is a control algorithm for fixing-set mark prevention control of the fifth embodiment.

FIG. 21 is a flowchart illustrating an algorithm of the fixing-set mark prevention control of the present embodiment. The flowchart differs from the flowchart (FIG. 15) of the fourth embodiment in that the processes (S501, S502) to extend the preset interval time in accordance with the warm-up index are performed between the step S404 to set the interval timer and the step S405 to start the countdown of the interval timer. That is, the interval time is set in accordance with the accumulated number of rotations of the pressure roller 124 in S404, and then a current warm-up index is calculated by using the warm-up index table (S501). Then, the extended time for the interval time that corresponds to the calculated current warm-up index is determined by using the interval-time addition table, and the extended time is added to the time that has been set in the interval timer (S502). After the start of the countdown of the interval timer in S405, the control is performed along the same flow as that of the fourth embodiment.

Merit of Fixing-Set Mark Prevention Control of Fifth Embodiment

Merits of the fixing-set mark prevention control of the present embodiment will be described, compared to the comparative example described in the fourth embodiment. In the comparative example, the set value of the interval time of the nip-position change control is constantly 10 minutes regardless of the accumulated number of rotations and the degree of heat storage of the pressure roller 124.

Figure 22:
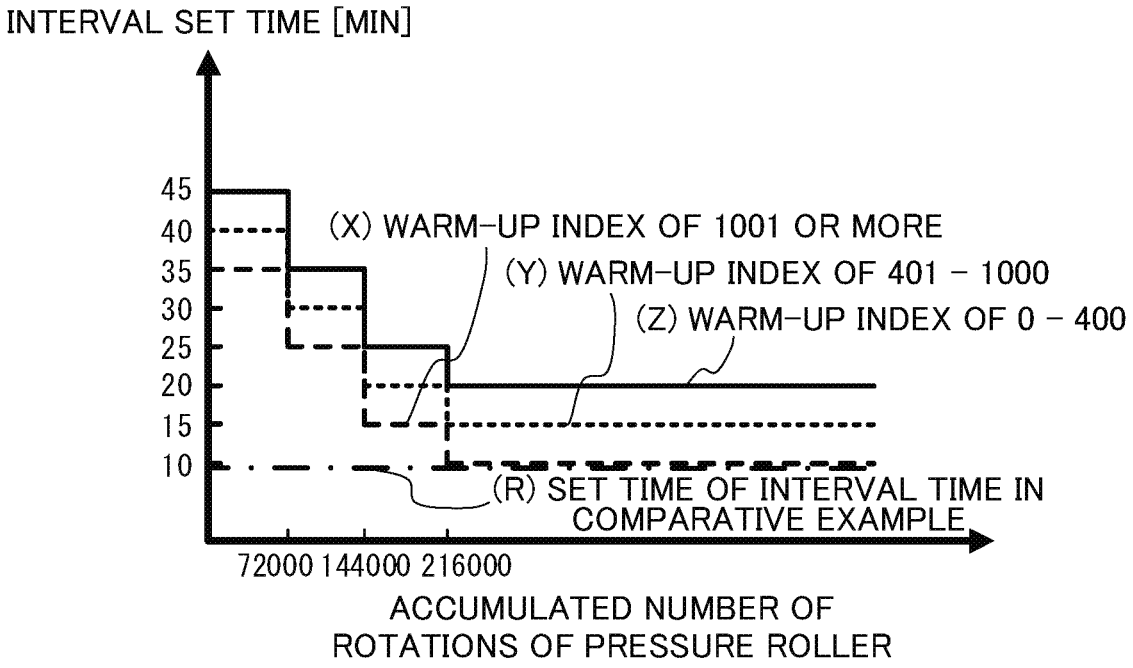
FIG. 22 is a diagram for illustrating a set value for an interval time of the fifth embodiment.

FIG. 22 is a graph illustrating a relationship between the value of the pressure-roller rotation counter and the set value of the interval time in the present embodiment and the comparative example. A symbol (X) indicates that the warm-up index at the completion of sheet passing is equal to or larger than 1,001 in the present embodiment. A symbol (Y) indicates that the warm-up index at the completion of sheet passing is equal to or larger than 401 and equal to or smaller than 1,000 in the present embodiment. A symbol (Z) indicates that the warm-up index at the completion of sheet passing is equal to or smaller than 400 in the present embodiment. A symbol (R) indicates the comparative example, in which the interval time is constantly 10 minutes regardless of the warm-up index.

As illustrated in FIG. 22, under the condition (X) in which the warm-up index is 1,001 or more, interval times longer than 10 minutes are set when the accumulated number of rotations of the pressure roller 124 is 216,000 or less. In addition, under the condition (Y) or (Z) in which the warm-up index is 1,000 or less, interval times longer than those under the condition (X) are set. Thus, compared to the image forming apparatus of the comparative example, the frequency of execution of the nip-position change control can be further reduced when the accumulated number of rotations of the pressure roller 124 is 216,000 or less or the warm-up index is 1,000 or less, even compared to the fourth embodiment. Consequently, the frequency of occurrence of the operation sound and the power consumption in the sleep state can be further suppressed.

Figure 23A:
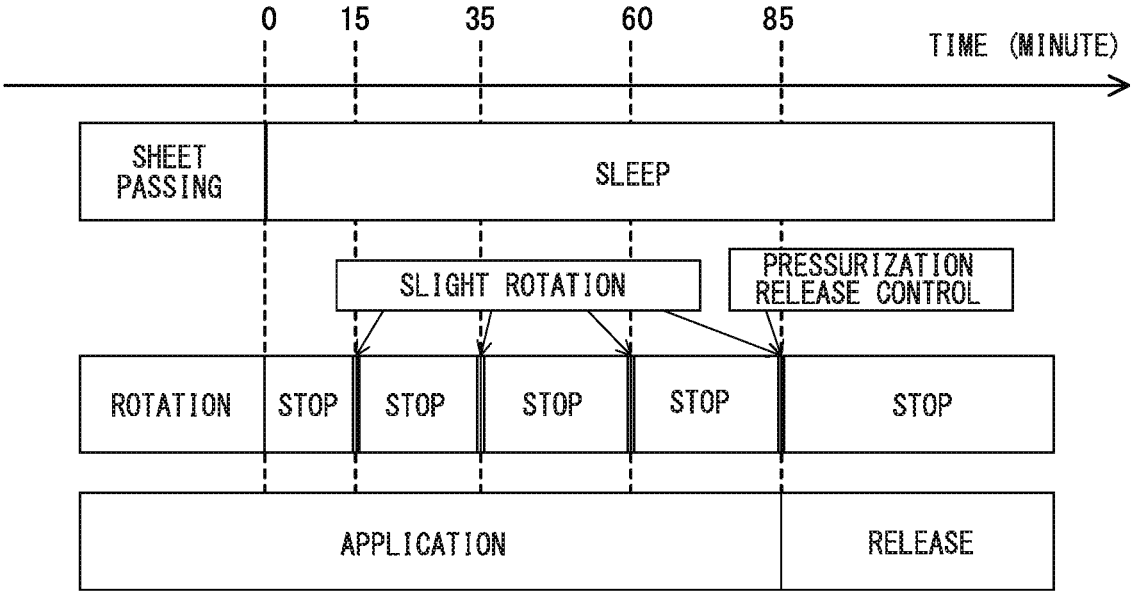
FIG. 23A illustrates a sequence of operations of the fixing-set mark control of the fifth embodiment.
Figure 23B:
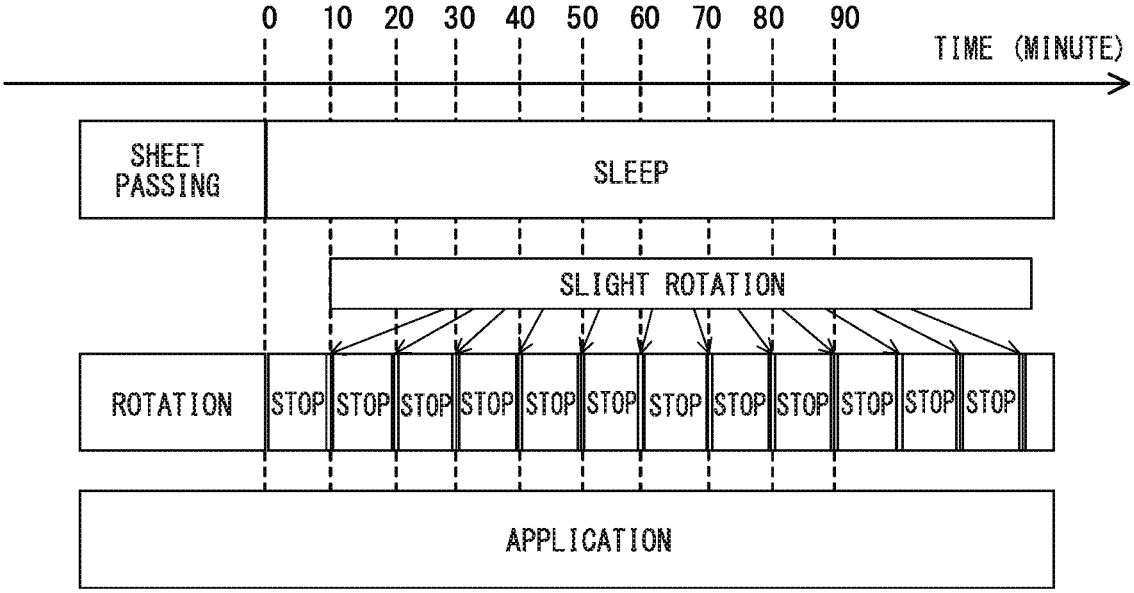
FIG. 23B illustrates a sequence of operations of the fixing-set mark control of the comparative example.

FIG. 23A illustrates an example of a sequence of operations of the nip-position change control of the image forming apparatus in the present embodiment. FIG. 23B illustrates an example of a sequence of operations of the nip-position change control of the image forming apparatus in the comparative example. In the examples of both the present embodiment and the comparative example, operations obtained after 100 sheets have been passed in the plain-paper mode are illustrated. The sheets are Red Label 80 g/m$^2$ made by Canon Oce. In addition, in both examples, the accumulated number of rotations of the pressure roller 124 at the completion of sheet passing is in a range from 144,001 to 216,000. The warm-up index decreases with the elapsed time. Specifically, the warm-up index is 1,001 or more at the completion of sheet passing (i.e., start of the sleep state), 400 to 1,000 at a point of time at which 15 minutes has elapsed, and less than 400 at a point of time at which 35 minutes has elapsed.

FIG. 23A illustrates a sequence of operations in the present embodiment. FIG. 23B illustrates a sequence of operations in the comparative example. As illustrated in FIGS. 23A and 23B, the number of times of execution of the nip-position change control obtained when 60 minutes has elapsed from the completion of sheet passing is three in the present embodiment, and six in the comparative example. Thus, it is understood that the present embodiment reduces the frequency of execution of the nip-position change control and suppresses the frequency of occurrence of the operation sound and the power consumption in the sleep state.

In the present embodiment, the specified number of times of the nip-position change control is set at four in accordance with the accumulated number of rotations of the pressure roller 124. Thus, in the present embodiment, as illustrated in FIG. 23A, the pressure release control is performed after 85 minutes has elapsed from the completion of sheet passing. Thus, it is also understood that since the present embodiment release the pressurization of the fixing film 123 and the pressure roller 124 and does not perform the nip-position change control after the 85 minutes has elapsed from the completion of sheet passing, the present embodiment can suppress the operation sound and the power consumption, compared to the comparative example in which the nip-position change control is repeated even after the 85 minutes has elapsed.

As described above, since the nip-position change control is performed with the interval time that is changed in accordance with the degree of use and the degree of heat storage of the fixing unit, the present embodiment can further suppress the frequency of occurrence of the operation sound and the power consumption in the sleep state, compared to the above-described fourth embodiment.

Modification

In the above-described fifth embodiment, the warm-up index is calculated by using a history of operations of the image forming apparatus, the degree of heat storage of the fixing unit is determined in accordance with the warm-up index, and the interval time of the nip-position change control is changed in accordance with the degree of heat storage. However, instead of the warm-up index, a core metal temperature or a surface temperature of the pressure roller 124 or the temperature of the fixing film 123 may be detected by a temperature detection unit, such as a thermistor, disposed in the fixing unit, and the degree of heat storage of the fixing unit may be determined depending on the detection result.

In addition, in the fifth embodiment, since the pressure release control is performed after the nip-position change control is executed the specified number of times, an elapsed time from the completion of sheet passing to the execution of the pressure release control changes, depending on the interval time. However, instead of this, the specified number of times may be changed so that the pressure release control is performed, regardless of the degree of heat storage of the fixing unit, in a time period at which a constant time has elapsed from the completion of the last sheet passing. For example, if the accumulated number of rotations of the pressure roller 124 has a constant value, the specified number of times may be changed in accordance with at least one of the warm-up index at the completion of sheet passing, the core metal temperature or the surface temperature of the pressure roller 124, and the temperature of the fixing film 123.

In addition, although the interval time of the nip-position change control is changed in the fifth embodiment in accordance with both of the degree of use and the degree of heat storage of the fixing unit, only the degree of heat storage of the fixing unit may be used. That is, the interval time may be changed in accordance with the warm-up index, not with the accumulated number of rotations of the pressure roller 124.

Sixth Embodiment

In a sixth embodiment, for improving productivity while preventing the fixing-set mark, the operation of the fixing-set mark prevention control in the transition to the sleep state and in the sleep state is determined depending on the information obtained in each time period and each type of the recording material, from among a history of operations of the image forming apparatus. Hereinafter, the same description as that for the first to the fifth embodiments will be omitted, and the description will be made, with a component having substantially the same structure and operation as a component of the above-described embodiments being given the same reference symbol.

As described above, if the fixing unit has been in the first pressurization state for a long time, in a stop period of sheet passing, the deformation caused by the pressurization in the fixing nip portion is left on one or both of the fixing film 123 and the pressure roller 124, as history, and causes the distortion. If an image having a high image-coverage rate is formed on a gloss paper in the occurrence of the distortion, the fixing-set mark will easily and significantly occur due to the distortion and the characteristic of the gloss paper. In contrast, if other types of sheets are passed, or an image having a low image-coverage rate is formed on a gloss paper, the fixing-set mark does not significantly occur even if the distortion occurs in either the fixing film 123 or the pressure roller 124.

Thus, in the present embodiment, the frequency of sheet passing of gloss paper and the frequency of outputting images having a high image-coverage rate are analyzed for each time period by using a history of operations, and whether to perform the pressure release control in the transition to the sleep state and the pressure keeping time after the transition to the sleep state are determined.

Functional Block in Sixth Embodiment

Figure 24:
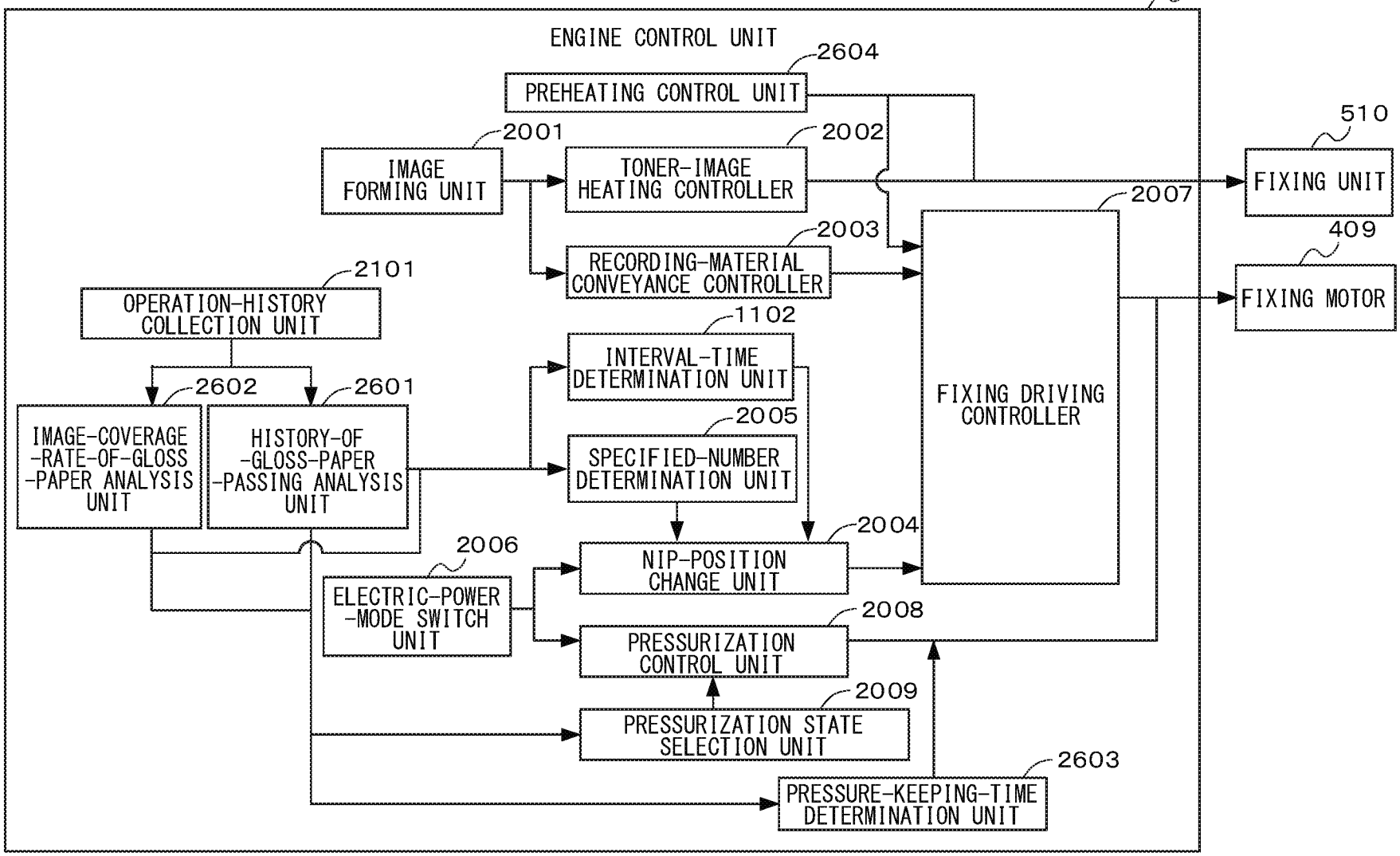
FIG. 24 is a functional block diagram in a sixth embodiment.

As illustrated in a functional block diagram of FIG. 24, an engine control unit 403 of the present embodiment includes a history-of-gloss-paper-passing analysis unit 2601 and an image-coverage-rate-of-gloss-paper analysis unit 2602 that have functions to analyze a history of operations of the image forming apparatus. The engine control unit 403 also includes a pressure-keeping-time determination unit 2603 that has functions related to the pressurization control. In addition, the engine control unit 403 also includes a preheating control unit 2604 that has functions related to the heat application.

The history-of-gloss-paper-passing analysis unit 2601 analyzes the number of gloss paper sheets that have been passed, for each time period by using data collected by the operation-history collection unit 2101. The time period is provided by dividing the time from 0:00 to 24:00, and has one hour. The image-coverage-rate-of-gloss-paper analysis unit 2602 analyzes the maximum image-coverage rate in the past gloss-paper passing by using the data collected by the operation-history collection unit 2101.

The pressurization-state selection unit 2009 selects, in the transition to the sleep state, whether to keep the pressurization state (first pressurization state) set in the sheet passing or release the pressurization, depending on an analysis result by the history-of-gloss-paper-passing analysis unit 2601 and on an analysis result by the image-coverage-rate-of-gloss-paper analysis unit 2602. The pressure-keeping-time determination unit 2603 determines a time (pressure keeping time) to keep the pressurization state after the start of the sleep state, depending on an analysis result by the history-of-gloss-paper-passing analysis unit 2601 and on an analysis result by the image-coverage-rate-of-gloss-paper analysis unit 2602. The pressurization-state selection unit 2009 selects the pressurization state of the fixing unit in the sleep state, depending on an analysis result by the history-of-gloss-paper-passing analysis unit 2601 and on an analysis result by the image-coverage-rate-of-gloss-paper analysis unit 2602. In addition, the pressure-keeping-time determination unit 2603 changes the pressure keeping time in accordance with a current time period, depending on an analysis result by the history-of-gloss-paper-passing analysis unit 2601 and on an analysis result by the image-coverage-rate-of-gloss-paper analysis unit 2602.

The preheating control unit 2604 is a function unit that sends a heating instruction to the fixing unit 510 in advance before the image-forming control portion 2001 sends a heating instruction to the fixing unit 510, and causes the fixing driving controller 2007 to rotate the fixing motor 409.

Method of Analyzing History of Operations in Sixth Embodiment

In the present embodiment, since the pressurization state of the fixing unit in the transition to the sleep state is changed in accordance with the operating conditions of the image forming apparatus, it is necessary to accumulate data on the history of operations of the image forming apparatus and estimate an optimum pressurization state for each time period.

First, a method of accumulating data on the operating conditions, as a history of operations, will be described. Specifically, a history of gloss-paper passing (the number of sheets), that is, the total number of gloss paper sheets that have been passed, is determined for each time period (one hour) of a day of the week, the day of last week, and the day before the last week (i.e., days of past three weeks). In addition, a maximum image-coverage rate (%) of gloss paper is determined for each time period of the days of the past three weeks. Note that a maximum image-coverage rate (%) for each sheet is sent from the controller unit 401 in the sheet passing, and that the maximum image-coverage rate (%) of gloss paper for each time period is the maximum value among the image-coverage rates (%) of gloss paper sheets that have been passed in the time period. In addition, histories of gloss-paper passing and maximum image-coverage rates of gloss paper of the past three weeks are each averaged by using following Equation 7, and thereby an averaged history of gloss-paper passing and an averaged maximum image-coverage rate of gloss paper are estimated for each time period of the day of the week.

$$\text{Data}_{ave}(\text{day,time})=\{\text{Data}_{week1}+\text{Data}_{week2}+\text{Data}_{week3}\}/3 \quad \text{Equation 7}$$

Table 8 illustrates the history of gloss-paper passing and the maximum image-coverage rate of gloss paper analyzed by the above-described analysis unit for each time period.

TABLE 8

| TIME PERIOD | 1 | 2 | ... | 8 | 9 | 10 | 11 | 12 | 13 | 14 | 15 | 16 | 17 | 18 | 19 | ... | 23 | 24 |
|---|---|---|---|---|---|---|---|---|---|---|---|---|---|---|---|---|---|---|
| HISTORY OF GLOSS-PAPER PASSING (SHEETS) | 0 | 0 | | 1 | 50 | 4 | 4 | 0 | 6 | 5 | 4 | 3 | 4 | 2 | 1 | | 0 | 0 |
| MAXIMUM IMAGE-COVERAGE RATE OF GLOSS PAPER [%] | — | — | | 120 | 180 | 15 | — | — | 140 | 78 | 193 | 23 | 5 | 182 | 170 | | — | — |

Method of Selecting Pressure Keeping Time in Sixth Embodiment

With reference to FIG. 25 and Table 9, a specific flow of the present embodiment will be described.

TABLE 9

| | | |
|---|---|---|
| REFERENCE 1 OF HISTORY OF GLOSS-PAPER PASSING (SHEETS) | X4 | 0 |
| REFERENCE 2 OF HISTORY OF GLOSS-PAPER PASSING (SHEETS) | X5 | 10 |
| THRESHOLD OF MAXIMUM IMAGE-COVERAGE RATE (%) | Z1 | 30 |
| WAIT TIME TO PRESSURE RELEASE (MINUTE) | Y4 | 30 |

When transitioning to the sleep state (S601), the engine control unit 403 causes the operation-history analysis unit to check a current time period (S602), a history of gloss-paper passing (S603) and a maximum image-coverage rate of gloss paper (S604) in the current time period. If the history of gloss-paper passing in the current time period is X4 (that is the number of sheets) (S605), then the engine control unit 403 determines that the engine control unit 403 continues the pressurization (keeps the pressurization state that is set in the sheet passing) after the transition to the sleep state (S608), and performs the pressurization (S609). In this case, since the frequency of sheet passing of gloss paper is low in the current time period, it is determined that the possibility of occurrence of the fixing-set mark on the gloss paper sheet is low.

If the history of gloss-paper passing in the current time period is one or more (S605), and the maximum image-coverage rate of gloss paper in the current time period is equal to or less than Z1 (%) (S606), then the engine control unit 403 determines that the engine control unit 403 continues the pressurization after the transition to the sleep state (S608), and performs the pressurization (S609). In this case, since the maximum image-coverage rate of gloss paper is low in the current time period, it is determined that the possibility of occurrence of the fixing-set mark on the gloss paper sheet is low.

If the history of gloss-paper passing in the current time period is more than X4 and equal to or smaller than X5 (S605, S607), and the maximum image-coverage rate of gloss paper in the current time period is equal to or larger than Z1 (%) (S606), then the engine control unit 403 sets a Y4 (minute) to the time from the current time to the time of the pressure release (S610). In this case, the engine control unit 403 remains to perform the pressurization in the transition to the sleep state (S611), waits until the Y4 (minute) elapses from the transition to the sleep state (S612), and performs the pressure release at the elapse of the Y4 (minute) (S613). In this case, it is determined that if the pressurization is kept long in the sleep state, the fixing-set mark may occur on a gloss paper sheet.

If the history of gloss-paper passing in the current time period is more than X5 (S605, S607), and the maximum image-coverage rate of gloss paper in the current time period is equal to or larger than Z1 (%) (S606), then the engine control unit 403 performs the pressure release immediately at the transition to the sleep state (S613). In this case, since the frequency of sheet passing of gloss paper is relatively high in the current time period and the maximum image-coverage rate can also be high in the time period, it is determined that the fixing-set mark of the gloss paper sheet has to be more reliably avoided.

In all cases described above, the engine control unit 403 waits until the transition to the next time period (S614), and ends the flow if the engine control unit 403 performs the pressure release before the transition to the next time period (S615). If the engine control unit 403 remains to perform the pressurization at the transition to the next time period (S615), then the engine control unit 403 checks a current time again (S602), checks a history of gloss-paper passing (S603) and a maximum image-coverage rate of gloss paper (S604) in the current time period, and repeats the above-described steps S605 to S615.

Extending Pre-Rotation in Gloss Paper Passing in Sixth Embodiment

If the pressurization is continued after the transition to the sleep state in accordance with the above-described flowchart, and an instruction to pass a gross paper sheet having a high image-coverage rate is performed contrary to expectation, there is a concern that the fixing-set mark may occur in an image due to the distortion in the fixing nip portion. Thus, in the present embodiment, if the instruction to perform the sheet passing is received in such a condition, a time period for the operation (pre-rotation) to heat and rotate the fixing film 123 before the start of the sheet passing is extended by a predetermined time sufficient to eliminate the distortion of the pressure roller 124. By extending the time period for the pre-rotation, an outer circumferential surface of the pressure roller 124 is gradually made even when passing through the fixing nip portion, and the deformation caused by the pressurization is reduced.

Merit of Selecting Pressure Keeping Time in Sixth Embodiment

Next, effects of selecting the pressure keeping time in the sixth embodiment will be described. For example, suppose that the engine control unit 403 receives a sleep transition instruction from the controller unit 401 at 9:00. The engine control unit 403 checks the history of gloss-paper passing in the time period from 9:00 to 10:00 (time period of 9) in which the gloss-paper passing was performed in the time period in the past, and the maximum image-coverage rate (%) obtained when the gloss paper sheets were passed. In Table 8, the history of gloss-paper passing in the time period of 9 is 50 (sheets) and the maximum image-coverage rate (%) obtained when the gloss paper sheets were passed is 180%. Thus, the engine control unit 403 determines that a gloss paper sheet having a high image-coverage rate will be highly likely passed, and immediately performs the pressure release control at the transition to the sleep state. With this operation, when the instruction for passing a gloss paper sheet having a high image-coverage rate is actually performed, a product can be outputted, without producing the fixing-set mark caused by the distortion of the fixing film or the pressure roller.

As another example, suppose that the engine control unit 403 receives a sleep transition instruction from the controller unit 401 at 12:00. In Table 8, the history of gloss-paper passing in the time period from 12:00 to 13:00 (time period of 12) is zero. Thus, the engine control unit 403 determines that the instruction for passing a gloss paper sheet having a high image-coverage rate will be less likely performed, and keeps the pressurization state that is set in the sheet passing, in the time period from 12:00 to 13:00. With this operation, when a sheet passing instruction is performed with a condition other than the conditions of high image-coverage rate and gloss paper, an optimum SFPOT can be obtained. Note that, contrary to expectation, if a sheet passing instruction is performed with the conditions of high image-coverage rate and gloss paper, the time period for the pre-rotation is extended by a predetermined time necessary to eliminate the distortion of the pressure roller 124. Thus, the occurrence of the fixing-set mark can be prevented.

As described above, in the sixth embodiment, the pressurization state of the fixing unit in the transition to the sleep state is selected, and the time period from the transition to the sleep state to the pressure release is determined selected in accordance with the frequency of sheet passing of gross paper and the maximum image-coverage rate of gloss paper by using the history of operations of the image forming apparatus. With this operation, the optimum SFPOT, operation sound, and power consumption can be obtained for a use environment of the image forming apparatus. Note that the method of estimating the operating conditions is not limited to the present embodiment, and the time period and the number of samples for averaging can be optimized for an environment where the image forming apparatus is installed.

Seventh Embodiment

In a seventh embodiment, for improving productivity while preventing the fixing-set mark, the pressurization state of the fixing unit in the transition to the sleep state is selected depending on the information on gloss paper, from among a history of operations of the image forming apparatus. Hereinafter, the same description as that for the first to the sixth embodiments will be omitted, and the description will be made, with a component having substantially the same structure and operation as a component of the above-described embodiments being given the same reference symbol.

As described above, if a gloss paper sheet is passed after the fixing unit has been left in the first pressurization state in a stop period of sheet passing, the fixing-set mark tends to easily occur. Thus, in the present embodiment, the frequency of sheet passing of gloss paper is analyzed for each time period by using a history of operations, and whether to perform the pressure release control in the transition to the sleep state is determined depending on an analysis result.

Functional Block in Seventh Embodiment

Figure 26:
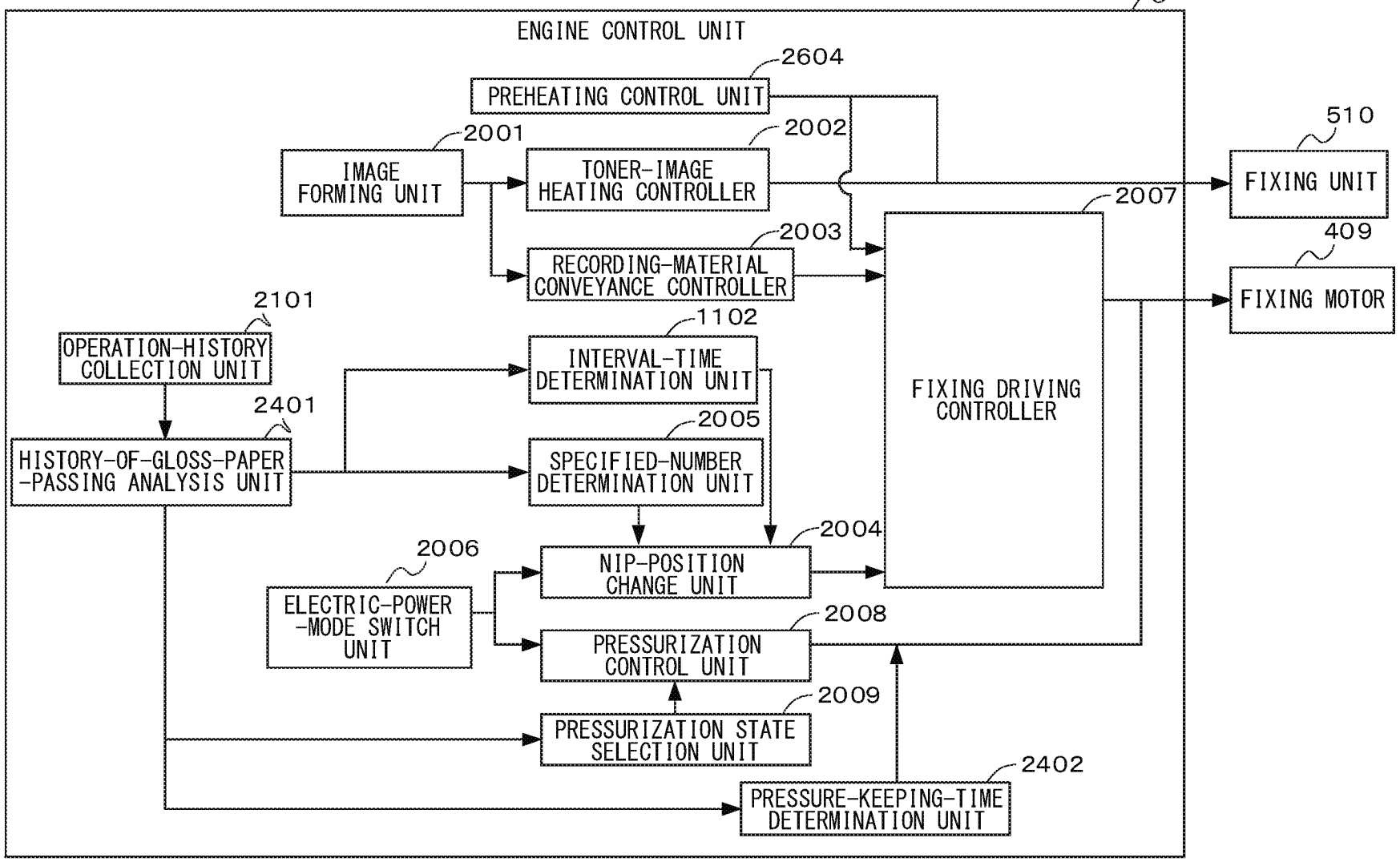
FIG. 26 is a functional block diagram in a seventh embodiment.

As illustrated in a functional block diagram of FIG. 26, an engine control unit 403 of the present embodiment includes a history-of-gloss-paper-passing analysis unit 2401 that has functions to analyze a history of operations of the image forming apparatus. In addition, the engine control unit 403 also includes a pressure-keeping-time determination unit 2402 that has functions related to the fixing-pressurization control.

The history-of-gloss-paper-passing analysis unit 2401 analyzes a history on the gloss-paper passing having been performed since the image forming apparatus was installed in a customer's site, by using data collected by the operation-history collection unit 2101. The pressurization-state selection unit 2009 determines to keep the pressurization state or release the pressurization, in the transition to the sleep state or during the sleep state, depending on an analysis result by the history-of-gloss-paper-passing analysis unit 2401. The pressure-keeping-time determination unit 2402 determines a pressure keeping time for the sleep state, depending on an analysis result by the history-of-gloss-paper-passing analysis unit 2401.

Method of Selecting Pressure Keeping Time in Seventh Embodiment

Figure 27:
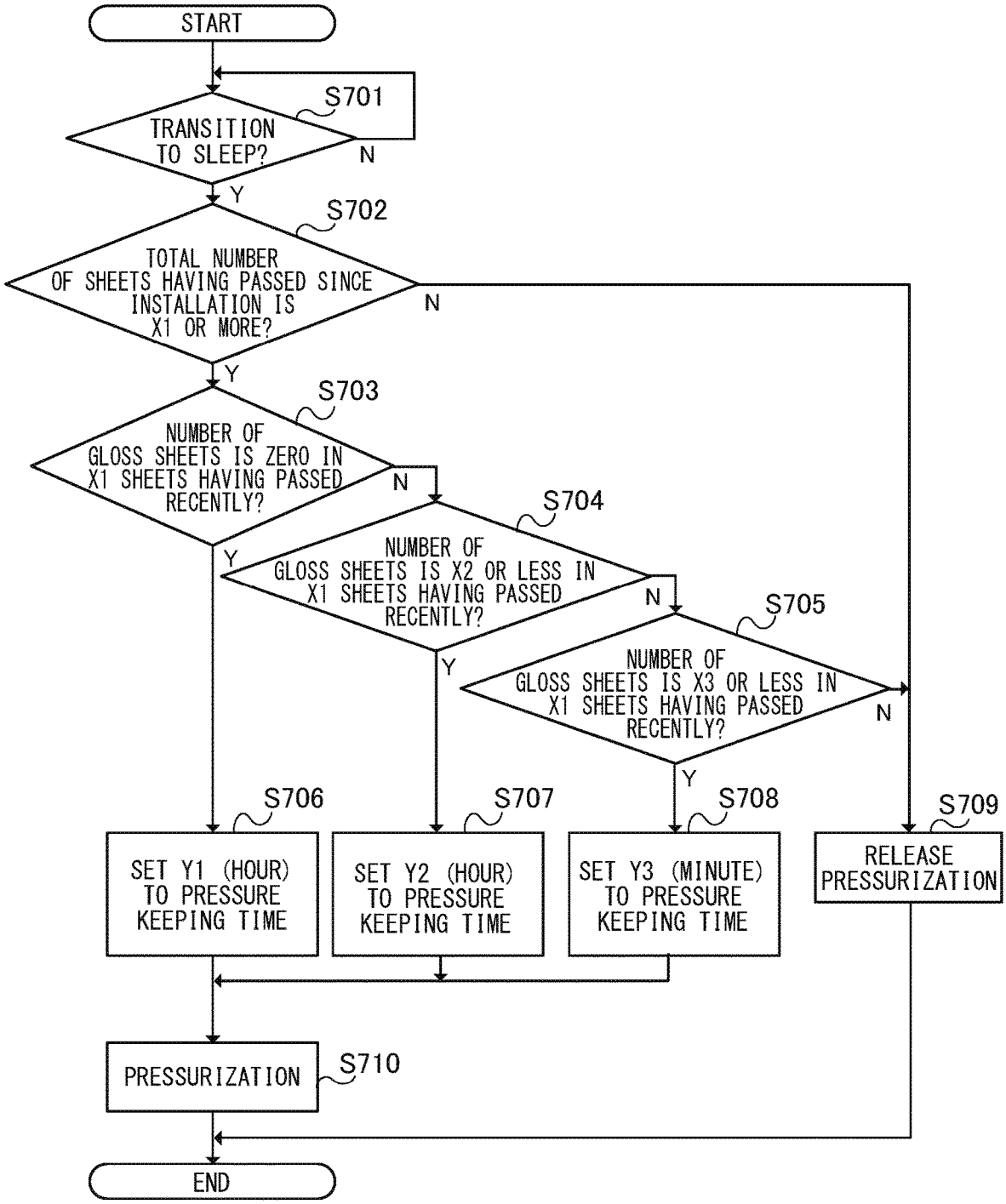
FIG. 27 is a flowchart for selecting a pressure keeping time in the seventh embodiment.

Next, with reference to FIG. 27 and Table 10, a specific control flow will be described.

TABLE 10

| | | |
|---|---|---|
| REFERENCE OF NUMBER OF SHEETS HAVING PASSED RECENTLY (SHEETS) | X1 | 1000 |
| REFERENCE 1 OF FREQUENCY OF GLOSS-PAPER PASSING (SHEETS) | X2 | 5 |
| REFERENCE 2 OF FREQUENCY OF GLOSS-PAPER PASSING (SHEETS) | X3 | 30 |
| PRESSURE KEEPING TIME (HOUR) | Y1 | 8 |
| PRESSURE KEEPING TIME (HOUR) | Y2 | 2 |
| PRESSURE KEEPING TIME (MINUTE) | Y3 | 30 |

When transitioning to the sleep state (S701), the engine control unit 403 determines whether the total number of sheets having been passed since the installation of the image forming apparatus is equal to or larger than X1 (that is the number of sheets), by using an analysis result by the operation-history analysis unit (S702). If the total number of sheets having been passed is less than X1, then the engine control unit 403 performs the pressure release control immediately at the transition to the sleep state (S709), and ends the process. This is because the frequency of sheet passing of gloss paper cannot be accurately estimated because the history of operations has not been sufficiently collected.

If the number of sheets having been passed since the installation of the image forming apparatus is equal to or larger than X1 (S702), then the engine control unit 403 changes the time period (pressure keeping time) from the transition to the sleep state to the pressure release, in accordance with the ratio of the number of gloss paper sheets to the number X1 of the sheets, which have been passed recently. Specifically, if there is no gloss paper sheets in the X1 sheets (S703), then the engine control unit 403 sets a Y1 (hour) to the pressure keeping time (S706). If the number of gloss paper sheets having been passed is one or more and equal to or smaller than X2 in the X1 sheets (S704), then the engine control unit 403 sets a Y2 (hour) to the pressure keeping time (S707). If the number of gloss paper sheets having been passed is larger than X2 and equal to or smaller than X3 in the X1 sheets (S705), then the engine control unit 403 sets a Y3 (minute) to the pressure keeping time (S708). In these cases, the engine control unit 403 keeps the pressurization state (first pressurization state), set in the sheet passing, in the transition to the sleep state by performing the fixing-pressurization (S710), and performs the pressure release when the pressure keeping time Y1, Y2, or Y3 has elapsed from the transition to the sleep state. If the number of sheets having been passed is larger than X3 in the X1 sheets (S705), then the engine control unit 403 performs the pressure release control immediately at the transition to the sleep state (S709), and ends the process.

Merit of Selecting Pressure Keeping Time in Seventh Embodiment

In the present embodiment, if more than 30 gloss paper sheets are included in 1,000 sheets having been passed recently, it is expected that gloss paper sheets will be frequently passed. Thus, the pressure release is performed at the transition to the sleep state. With this operation, the fixing-set mark caused by the distortion of the pressure roller or the like can be prevented from occurring in the next sheet passing. In addition, as the history of gloss-paper passing in 1,000 sheets having been passed recently decreases, it is determined that a gloss paper sheet will be less likely passed in the next sheet passing. Thus, the pressure keeping time from the transition to the sleep state to the pressure release is set longer for improving the SFPOT. If the history of gloss-paper passing in 1,000 sheets having been passed recently is zero, it is expected that almost no gloss paper sheets will be passed. Thus, the time period from the transition to the sleep state to the pressure release is set at 8 hours. Note that the 8 hours is the shortest time in which the fixing-set mark starts to occur due to the distortion of the pressure roller or the like in a case where a type of sheet other than the gloss paper sheet is passed.

Thus, in the present embodiment, the pressurization state in the transition to the sleep state is selected, and the pressure keeping time after the transition to the sleep state is determined in accordance with the frequency of sheet passing of gross paper and a time period in which the transition to the sleep state is performed, by using the history of operations of the image forming apparatus. With this operation, the SFPOT, the operation sound, and the power consumption can be optimized for a use environment of the image forming apparatus.

In addition, in the present embodiment, if an instruction to pass a gloss paper sheet is performed, contrary to expectation, in the pressure keeping time, the occurrence of the fixing-set mark can be prevented by extending the time period of the pre-rotation of the fixing unit to eliminate the distortion of the pressure roller or the like.

Note that the method of estimating the operating conditions of the image forming apparatus is not limited to the method described as an example in the present embodiment. For example, the selection of the fixing-pressurization state performed at the start of the sleep state and the determination of the pressure keeping time in the sleep state may be performed depending on a sheet passing history of a type of paper other than the gloss paper.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-172336, filed on Sep. 20, 2019, which is hereby incorporated by reference herein in its entirety.

What is claimed is:

1. An image forming apparatus comprising:

an electrophotographic image forming unit that forms a toner image on a recording material;

a fixing unit comprising a first rotary member, a second rotary member configured to form a nip portion between the first rotary member and the second rotary member, a pressurization mechanism that changes a state of the first rotary member and the second rotary member between a first pressurization state and a second pressurization state, and a heater configured to heat the toner image on the recording material, wherein the fixing unit is configured to fix the toner image to the recording material on which the toner image has been formed by the image forming portion, by the heater heating the toner image while the recording material being conveyed at the nip portion by the first rotary member and the second rotary member in the first pressurization state, wherein the first pressurization state is a state in which the first rotary member and the second rotary member abut against each other to form the nip portion, and wherein the second pressurization state is a state in which pressing force between the first rotary member and the second rotary member is smaller than pressing force in the first pressurization state or a state in which the first rotary member and the second rotary member are separated from each other;

a motor that drives at least one of the first rotary member and the second rotary member; and a control portion configured to control the motor driving source and the pressurization mechanism, and capable of performing:

first control that causes the motor to rotate the first rotary member and then stop the first rotary member, while continuing the first pressurization state from a last image forming operation; and second control that causes the pressurization mechanism to change the state of the first rotary member and the second rotary member from the first pressurization state to the second pressurization state, wherein, in a print stop period from a completion of the last image forming operation to a start of a next image forming operation, the control portion is configured to perform the first control before a number of times of execution of the first control in the print stop period reaches a predetermined number of times, and perform the second control after the number of times of execution of the first control in the print stop period reaches the predetermined number of times, and wherein the predetermined number of times is set for each time period in a day, and the predetermined number of times in at least one time period is different from the predetermined number of times in another time period.

2. The image forming apparatus according to claim 1, wherein the control portion is configured to change the predetermined number of times set for each time period, in accordance with a history of operations of the image forming apparatus.

3. The image forming apparatus according to claim 2, wherein the control portion is configured to change the predetermined number of times in accordance with an average length of the print stop period in each time period of the history of operations of the image forming apparatus.

4. The image forming apparatus according to claim 2, wherein the control portion is configured to change the predetermined number of times in accordance with a number of times of an image forming operation that is totalized for each time period of the history of operations of the image forming apparatus and for each type of the recording material.

5. The image forming apparatus according to claim 2, wherein the control portion is configured to change the predetermined number of times in accordance with a maximum image-coverage rate determined for each time period of the history of operations of the image forming apparatus and for each type of the recording material.

6. The image forming apparatus according to claim 1, wherein if the control portion changes the state of the first rotary member and the second rotary member from the first pressurization state to the second pressurization state in the print stop period, and a predetermined condition is satisfied in the print stop period, the control portion causes the pressurization mechanism to change the state of the first rotary member and the second rotary member from the second pressurization state to the first rotary member before receiving an instruction for a next image forming operation.

7. The image forming apparatus according to claim 6, wherein the predetermined condition is that an expected return time has elapsed, and wherein the control portion is configured to set the expected return time in accordance with an average length of the print stop period in each time period of a history of operations of the image forming apparatus.

8. The image forming apparatus according to claim 1, wherein the control portion is configured to repeat the first control the predetermined number of times, at predetermined constant intervals in the print stop period.

9. The image forming apparatus according to claim 1, wherein if the first rotary member and the second rotary member are in the second pressurization state when the control portion receives an instruction for an image forming operation, the control portion causes the motor to rotate the first rotary member and the second rotary member while causing the heater to perform preheating, before the image forming operation is started, for a time longer than a time in which the first rotary member and the second rotary member are in the first pressurization state when the control portion receives the instruction for the image forming operation.

10. The image forming apparatus according to claim 1, wherein the first rotary member is a pressure roller including an elastic layer, wherein the second rotary member is an endless fixing film that is externally fitted to a guide member that faces the pressure roller, wherein the heater is disposed in an inner space of the fixing film, and wherein the nip portion is formed by the heater and the pressure roller nipping the fixing film.

11. An image forming apparatus comprising:

an image forming portion configured to form a toner image on a recording material;

a fixing unit comprising a first rotary member, a second rotary member configured to form a nip portion between the first rotary member and the second rotary member, a pressurization mechanism that changes a state of the first rotary member and the second rotary member between a first pressurization state and a second pressurization state, and a heater configured to heat the toner image on the recording material, wherein the fixing unit is configured to fix the toner image to the recording material on which the toner image has been formed by the image forming portion, by the heater heating the toner image while the recording material being conveyed at the nip portion by the first rotary member and the second rotary member in the first pressurization state, wherein the first pressurization state is a state in which the first rotary member and the second rotary member abut against each other to form the nip portion, and wherein the second pressurization state is a state in which pressing force between the first rotary member and the second rotary member is smaller than pressing force in the first pressurization state or a state in which the first rotary member and the second rotary member are separated from each other;

a motor that drives at least one of the first rotary member and the second rotary member; and a control portion configured to control the motor and the pressurization mechanism, and capable of performing:

first control that causes the motor to rotate the first rotary member and then stop the first rotary member, while continuing the first pressurization state from a last image forming operation; and second control that causes the pressurization mechanism to change the state of the first rotary member and the second rotary member from the first pressurization state to the second pressurization state, wherein, in a print stop period from a completion of the last image forming operation to a start of a next image forming operation, the control portion is configured to perform the first control before a number of times of execution of the first control in the print stop period reaches a predetermined number of times, and perform the second control after the number of times of execution of the first control in the print stop period reaches the predetermined number of times, and wherein the control portion is configured to change an interval time at which the first control is performed the predetermined number of times in the print stop period.

12. The image forming apparatus according to claim 11, wherein the control portion is configured to shorten the interval time as an accumulated number of rotations of the first rotary member and the second rotary member increases.

13. The image forming apparatus according to claim 11, wherein the control portion is configured to shorten the interval time as an accumulated time of rotation of the first rotary member and the second rotary member increases.

14. The image forming apparatus according to claim 11, wherein the control portion is configured to shorten the interval time as an accumulated number of sheets of the recording material on which images have been formed increases.

15. The image forming apparatus according to claim 11, wherein the control portion is configured to set the interval time shorter as a number of sheets of the recording material on which images have been formed in a predetermined period of time preceding a completion of a last image forming operation increases.

16. The image forming apparatus according to claim 11, further comprising a temperature detector that detects a temperature of at least one of the first rotary member and the second rotary member, wherein the control portion is configured to change the interval time in accordance with a detection result by the temperature detector.

17. An image forming apparatus comprising:

an image forming portion configured to form a toner image on a recording material;

a fixing unit comprising a first rotary member, a second rotary member configured to form a nip portion between the first rotary member and the second rotary member, a pressurization mechanism that changes a state of the first rotary member and the second rotary member between a first pressurization state and a second pressurization state, and a heater configured to heat the toner image on the recording material, wherein the fixing unit is configured to fix the toner image to the recording material on which the toner image has been formed by the image forming portion, by the heater heating the toner image while the recording material being conveyed at the nip portion by the first rotary member and the second rotary member in the first pressurization state, wherein the first pressurization state is a state in which the first rotary member and the second rotary member abut against each other to form the nip portion, and wherein the second pressurization state is a state in which pressing force between the first rotary member and the second rotary member is smaller than pressing force in the first pressurization state or a state in which the first rotary member and the second rotary member are separated from each other;

a motor that drives at least one of the first rotary member and the second rotary member; and a control portion configured to control the motor and the pressurization mechanism, and capable of switching a mode between:

a first mode in which electric power is supplied for executing an image forming operation; and a second mode in which power consumption is less than power consumption in the first mode, wherein in a case of transition from the first mode to the second mode in a print stop period from a completion of a last image forming operation to a start of a next image forming operation, the control portion is configured to select whether to keep the first rotary member and the second rotary member in the first pressurization state continuously from the last image forming operation, or to set the first rotary member and the second rotary member from the first pressurization state to the second pressurization state by the pressurization mechanism, and wherein the control portion is configured to select whether to keep the first rotary member and the second rotary member in the first pressurization state or to set the first rotary member and the second rotary member to the second pressurization state, in accordance with a time period in a day in which the transition from the first mode to the second mode is performed.

18. The image forming apparatus according to claim 17, wherein the control portion is configured to change setting whether to keep the first rotary member and the second rotary member in the first pressurization state or to set the first rotary member and the second rotary member to the second pressurization state in a case of a transition from the first mode to the second mode is performed in each time period in a day, in accordance with a history of operations of the image forming apparatus.

19. The image forming apparatus according to claim 18, wherein the control portion is configured to change the setting in each time period, in accordance with an average length of the print stop period in the time period of the history of operations of the image forming apparatus.

20. The image forming apparatus according to claim 19, wherein the control portion is configured to change the setting in each time period, in accordance with a maximum image-coverage rate determined for the time period of the history of operations of the image forming apparatus and for each type of the recording material.

21. The image forming apparatus according to claim 18, wherein the control portion is configured to change the setting in each time period, in accordance with a number of times of an image forming operation, totalized for the time period of the history of operations of the image forming apparatus and for each type of the recording material.

22. The image forming apparatus according to claim 17, wherein if the first rotary member and the second rotary member are in the second pressurization state when the control portion receives an instruction for an image forming operation, the control portion causes the motor to rotate the first rotary member and the second rotary member while causing the heater to perform preheating, before the image forming operation is started, for a time longer than a time in which the first rotary member and the second rotary member are in the first pressurization state when the control portion receives the instruction for the image forming operation.

23. The image forming apparatus according to claim 17, wherein the first rotary member is a pressure roller including an elastic layer, wherein the second rotary member is an endless fixing film that is externally fitted to a guide member that faces the pressure roller, wherein the heater is disposed in an inner space of the fixing film, and wherein the nip portion is formed by the heater and the pressure roller nipping the fixing film.

* * * * *